US011402781B2

(12) United States Patent
Seto et al.

(10) Patent No.: US 11,402,781 B2
(45) Date of Patent: Aug. 2, 2022

(54) HEATING DEVICE, LIQUID APPLYING APPARATUS, IMAGE FORMING APPARATUS, POST-PROCESSING APPARATUS, AND CONVEYING DEVICE

(71) Applicants: Takashi Seto, Kanagawa (JP); Takamasa Hase, Tokyo (JP)

(72) Inventors: Takashi Seto, Kanagawa (JP); Takamasa Hase, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/128,211

(22) Filed: Dec. 21, 2020

(65) Prior Publication Data

US 2021/0200128 A1 Jul. 1, 2021

(30) Foreign Application Priority Data

Dec. 26, 2019 (JP) ..... JP2019-236158
Dec. 26, 2019 (JP) ..... JP2019-236163

(51) Int. Cl.
*G03G 15/20* (2006.01)
*B41J 11/00* (2006.01)

(52) U.S. Cl.
CPC ..... *G03G 15/2053* (2013.01); *B41J 11/002* (2013.01); *G03G 15/2064* (2013.01)

(58) Field of Classification Search
CPC ..... G03G 15/10; G03G 15/2053; G03G 15/6576; G03G 2215/00662; G03G 2215/00704; B41J 11/002
See application file for complete search history.

(56) References Cited

U.S. PATENT DOCUMENTS

| | | | | |
|---|---|---|---|---|
| 5,995,797 | A | 11/1999 | Shigeta et al. | |
| 2002/0051665 | A1 | 5/2002 | Seto et al. | |
| 2003/0129008 | A1 | 7/2003 | Seto | |
| 2005/0002054 | A1 | 1/2005 | Shoji et al. | |
| 2010/0014903 | A1 | 1/2010 | Seto et al. | |
| 2011/0217091 | A1 | 9/2011 | Hirose et al. | |
| 2011/0305491 | A1 | 12/2011 | Hasegawa et al. | |
| 2012/0044516 | A1 | 2/2012 | Hirose et al. | |
| 2016/0101635 | A1 | 4/2016 | Hoshino et al. | |
| 2016/0355029 | A1 | 12/2016 | Kondo | |
| 2018/0339528 | A1 | 11/2018 | Ueda et al. | |
| 2019/0061381 | A1* | 2/2019 | Tamai | B41J 11/0005 |
| 2019/0202215 | A1* | 7/2019 | Asada | B41J 11/007 |

FOREIGN PATENT DOCUMENTS

| | | | |
|---|---|---|---|
| EP | 0 930 548 | A1 | 7/1999 |
| EP | 1 300 252 | A2 | 4/2003 |
| EP | 2 179 855 | A2 | 4/2010 |
| JP | 2016-078428 | | 5/2016 |
| JP | 2019-119606 | A | 7/2019 |

OTHER PUBLICATIONS

Extended European Search Report dated Apr. 23, 2021 in European Patent Application No. 20213114.0, 9 pages.

* cited by examiner

*Primary Examiner* — Thomas S Giampaolo, II
(74) *Attorney, Agent, or Firm* — Xsensus LLP

(57) ABSTRACT

A novel heating device includes a heating member configured to heat a sheet on an opposite face opposite a liquid applied face. The heating member has a curved portion along which the sheet is conveyed and warped so that the liquid applied face has a concave shape.

22 Claims, 16 Drawing Sheets

HEATING DEVICE, LIQUID APPLYING APPARATUS, IMAGE FORMING APPARATUS, POST-PROCESSING APPARATUS, AND CONVEYING DEVICE

CROSS-REFERENCE TO RELATED APPLICATIONS

This patent application is based on and claims priority pursuant to 35 U.S.C. § 119(a) to Japanese Patent Application Nos. 2019-236158, filed on Dec. 26, 2019, and 2019-236163, filed on Dec. 26, 2019, in the Japan Patent Office, the entire disclosure of each of which is hereby incorporated by reference herein.

BACKGROUND

Technical Field

Embodiments of the present disclosure relate to a heating device, a liquid applying apparatus, an image forming apparatus, a post-processing apparatus, and a conveying device.

Background Art

Various types of drying devices, each of which are provided as a heating device in an image forming apparatus such as a copier and a printer, are known to heat a sheet to dry liquid on the sheet.

For example, even if cockling (waving) occurs to a sheet when liquid is applied to the sheet, a known drying device eliminates the cockling and causes the sheet to closely contact a tension roller to dry the sheet efficiently.

SUMMARY

At least one aspect of this disclosure, a novel heating device includes a heating member configured to heat a sheet on an opposite face opposite a liquid applied face. The heating member has a curved portion along which the sheet is conveyed and warped so that the liquid applied face has a concave shape.

Further, at least one aspect of this disclosure, a liquid applying apparatus includes a liquid applier configured to apply a liquid to a sheet, and the above-described heating device.

Further, at least one aspect of this disclosure, an image forming apparatus includes an image forming device configured to form an image on a sheet with liquid, and the above-described heating device.

Further, at least one aspect of this disclosure, a post-processing apparatus includes the above-described heating device and a post-processing device configured to perform a post-processing operation to a sheet that has passed the heating device.

Further, at least one aspect of this disclosure, a conveying device includes the above-described heating device and a conveyance passage configured to convey a sheet that has passed the heating device, to a post-processing device to perform a post-processing operation to the sheet.

BRIEF DESCRIPTION OF THE SEVERAL VIEWS OF THE DRAWINGS

Exemplary embodiments of this disclosure will be described in detail based on the following figures, wherein.

Figure 1:
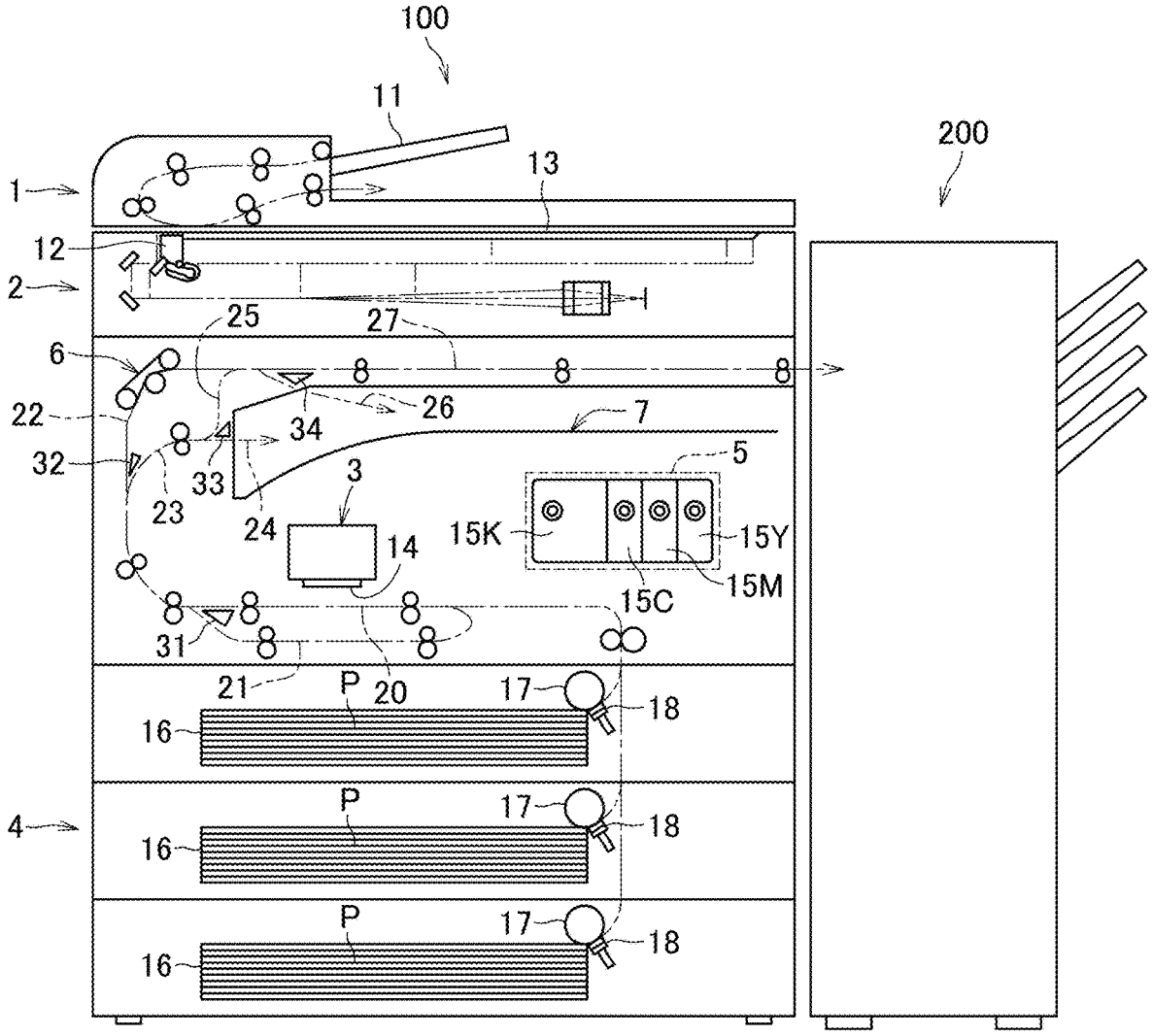
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to a drying device, a liquid applying apparatus, an image forming apparatus, a post-processing apparatus, and a conveying device. It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus according to an embodiment of the present disclosure.

As illustrated in FIG. 1, an image forming apparatus 100 according to the present embodiment includes an original document conveying device 1, an image reading device 2, an image forming device 3, a sheet feeding device 4, a cartridge container 5, a drying device (heating device) 6, and a sheet ejection portion 7. Further, a sheet alignment apparatus 200 is disposed adjacent to the image forming apparatus 100.

The original document conveying device 1 separates an original document from the other original documents one by one from a set of original documents on an original document tray 11 and conveys the separated original document toward an exposure glass 13 of the image reading device 2. The original document conveying device 1 includes a plurality of conveyance rollers each functioning as an original document conveyor to convey the original document.

The image reading device 2 is an image scanner, that is, a device to scan the image on an original document placed on the exposure glass 13 or the image on an original document as the original document passes over the exposure glass 13. The image reading device 2 includes an optical scanning unit 12 as an image reading unit. The optical scanning unit 12 includes a light source that irradiates an original document placed on the exposure glass 13 with light, and a charge-coupled device (CCD) as an image reader that reads an image from the reflected light of the original document. Further, a close contact-type image sensor (CIS) may be employed as an image reader.

The image forming device 3 includes a liquid discharge head 14 that functions as a liquid discharger to discharge ink that is liquid used for image formation. The liquid discharge head 14 may be a serial-type liquid discharge head that discharges ink while moving in the main scanning direction of a sheet (i.e., the sheet width direction) or a line-type liquid discharge head that discharges ink without moving a plurality of liquid discharge heads aligned in the main scanning direction.

Ink cartridges 15Y, 15M, 15C, and 15K are detachably attached to the cartridge container 5. The ink cartridges 15Y, 15M, 15C, and 15K are filled with inks of different colors such as yellow, magenta, cyan, and black, respectively. The ink in each ink cartridge (i.e., the ink cartridges 15Y, 15M, 15C, 15K) is supplied to the liquid discharge head 14 by an ink supply pump.

The sheet feeding device 4 includes a plurality of sheet feed trays 16 each functioning as a sheet container. Each sheet feed tray 16 loads a bundle of sheets including a sheet P. Each sheet P on which an image is formed is a cut sheet cut in a predetermined size, e.g., A4 size and B4 size, and is previously contained in the sheet feed tray 16 in a corresponding sheet conveyance direction. Further, each sheet feed tray 16 includes a sheet feed roller 17 that functions as a sheet feeder and a sheet separation pad 18 that functions as a sheet separator.

The sheet alignment apparatus 200 functions as a post-processing apparatus to align and register the sheets P conveyed from the image forming apparatus 100. Further, in addition to the sheet alignment apparatus 200, another post-processing apparatus such as a stapling device that staples (binds) the sheets and a punching device that punches holes in the sheet may be installed.

To provide a fuller understanding of the embodiments of the present disclosure, a description is now given of the image forming operation of the image forming apparatus 100 according to the present embodiment of this disclosure, with continued reference to FIG. 1.

As an instruction is given to start the printing operation, the sheet P is fed from one sheet feed tray 16 of the plurality of sheet feed trays 16. To be more specific, as the sheet feed roller 17 rotates, the uppermost sheet P placed on top of the bundle of sheets P contained in the sheet feed tray 16 is fed by the sheet feed roller 17 and the sheet separation pad 18 while the uppermost sheet P is separated from the other sheets of the bundle of sheets.

When the sheet P is conveyed to a sheet conveyance passage 20 that extends in the horizontal direction and faces the image forming device 3, the image forming device 3 forms an image on the sheet P. To be more specific, the liquid discharge head 14 is controlled to discharge liquid (ink) according to image data of the original document read by the image reading device 2 or print data instructed to print by an external device, so that ink is discharged on the image forming surface (upper face) of the sheet P to form an image. Note that the image to be formed on the sheet P may be a meaningful image such as text or a figure, or a pattern having no meaning per se.

When a duplex printing is performed, the sheet P is conveyed in the opposite direction opposite the sheet conveyance direction at a position downstream from the image forming device 3 in the sheet conveyance direction, so that the sheet P is guided to a sheet reverse passage 21. To be more specific, after the trailing end of the sheet P has passed a first passage changer 31 that is disposed downstream from the image forming device 3 in the sheet conveyance direction, the sheet P is conveyed in the opposite direction. Further, after the trailing end of the sheet P has passed the first passage changer 31, the first passage changer 31 changes the sheet conveyance passage of the sheet P to the sheet reverse passage 21. Accordingly, the sheet P is guided to the sheet reverse passage 21. Then, as the sheet P passes through the sheet reverse passage 21, the sheet P is reversed upside down and conveyed to the image forming device 3 again. Then, the image forming device 3 repeats the same operation performed to the front face of the sheet P, so as to form an image on the back face of the sheet P.

A second passage changer 32 is disposed downstream from the first passage changer 31 in the sheet conveyance direction. The second passage changer 32 guides the sheet P with the image selectively to a sheet conveyance passage 22 that runs through the drying device 6 or to a sheet conveyance passage 23 that does not run through the drying device 6. When the sheet P is guided to the sheet conveyance passage 22 through which the sheet P passes the drying device 6, the drying device 6 dries the ink on the sheet P. On the other hand, when the sheet P is guided to the sheet conveyance passage 23 through which the sheet P does not pass the drying device 6, a third passage changer 33 guides the sheet P selectively to a sheet conveyance passage 24 toward the sheet ejection portion 7 or to a sheet conveyance passage 25 toward the sheet alignment apparatus 200. Further, after the sheet P has passed the drying device 6, a fourth passage changer 34 guides the sheet P selectively to a sheet conveyance passage 26 toward the sheet ejection portion 7 or to a sheet conveyance passage 27 toward the sheet alignment apparatus 200.

In a case in which the sheet P is guided to the sheet conveyance passage 24 or the sheet conveyance passage 26 toward the sheet ejection portion 7, the sheet P is ejected to the sheet ejection portion 7 with a liquid applied face of the sheet P down. On the other hand, in a case in which the sheet P is guided to the sheet conveyance passage 25 or the sheet conveyance passage 27 toward the sheet alignment apparatus 200, the sheet P is conveyed to the sheet alignment apparatus 200, so that the bundle of sheets P is aligned and stacked. Accordingly, a series of printing operations is completed.

Next, a description is given of the configuration of the drying device 6 according to the present embodiment.

Figure 2:
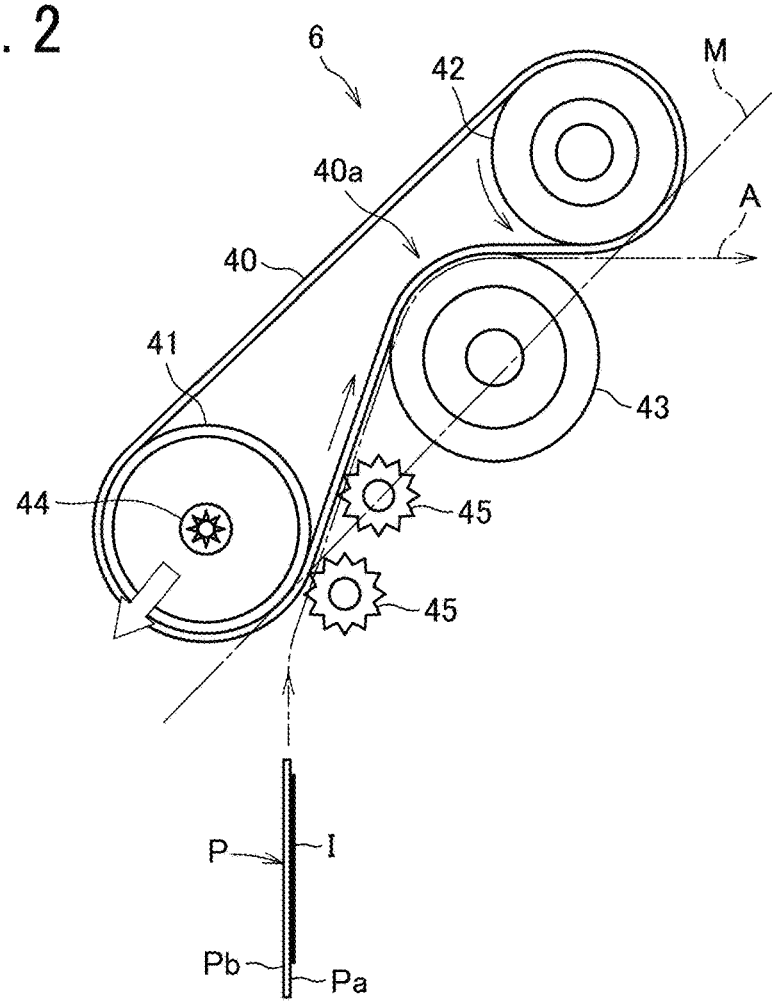
FIG. 2 is a diagram illustrating a schematic configuration of a drying device provided in the image forming apparatus of FIG. 1, according to an embodiment of the present disclosure.

FIG. 2 is a diagram illustrating a schematic configuration of the drying device 6 included in the image forming apparatus 100 of FIG. 1, according to an embodiment of the present disclosure.

As illustrated in FIG. 2, the drying device 6 includes a heating belt 40, a tension roller 41, a fixed roller 42, a pressure roller 43, a heater 44, and a plurality of spur wheels 45.

The heating belt 40 is a heating member to heat the sheet P while being in contact with the sheet P. The heating belt 40 includes an elastic endless belt that is wound around and rotatably supported by the tension roller 41 and the fixed roller 42.

The tension roller 41 and the fixed roller 42 are belt supports each rotatably supporting the heating belt 40. The tension roller 41 is movable inside the loop of the heating belt 40 and is pressed against the inner circumferential surface of the heating belt 40 by a biasing member such as a spring. On the other hand, the fixed roller 42 is fixed so as not to move.

The pressure roller 43 is a pressing member that presses the outer circumferential surface of the heating belt 40 between the tension roller 41 and the fixed roller 42. The tension roller 41 is disposed upstream from the pressure roller 43 in the sheet conveyance direction. The fixed roller 42 is disposed downstream from the pressure roller 43 in the sheet conveyance direction. The pressure roller 43 is pressed against the heating belt 40 by a pressing member such as a spring and a cam, toward the inside of the heating belt 40, in other words, toward the inside of the loop of the heating belt 40, from a common tangent line M that contacts the outer circumferential surface of the tension roller 41 and the outer circumferential surface of the fixed roller 42. By so doing, the heating belt 40 has a curved portion 40*a* that warps (curves) along the outer circumferential surface of the pressure roller 43.

The heater 44 is a heat source to heat the heating belt 40. In the present embodiment, the heater 44 is disposed inside the tension roller 41. Therefore, as the heater 44 generates heat, the heat is transmitted to the heating belt 40 via the tension roller 41, so that the heating belt 40 is heated. Accordingly, the tension roller 41 in the present embodiment functions as a heating member (heat rotator) to heat the heating belt 40 with the heat generated by the heater 44 disposed inside the tension roller 41. As a heat source, a radiation-type heater, e.g., a halogen heater and a carbon heater, to emit infrared ray, an electromagnetic induction-type heat source, and a warm air generation device may be employed. Further, the heater may be a contact-type heater or a non-contact type heater. In the present embodiment, a halogen heater is used as a heater 44.

Figure 3:
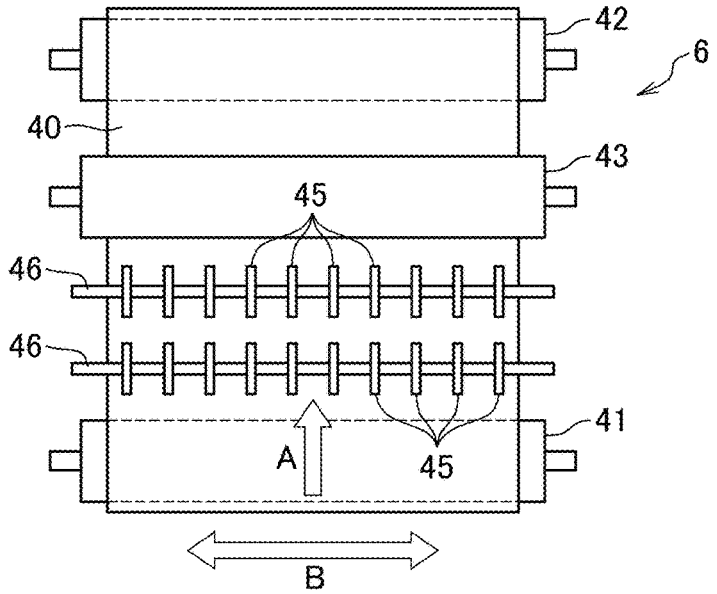
FIG. 3 is a plan view illustrating the drying device indicating the arrangement of spur wheels provided in the drying device of FIG. 2.

FIG. 3 is a plan view illustrating the drying device 6 indicating the arrangement of spur wheels 45 provided in the drying device 6 of FIG. 2.

Figure 4:
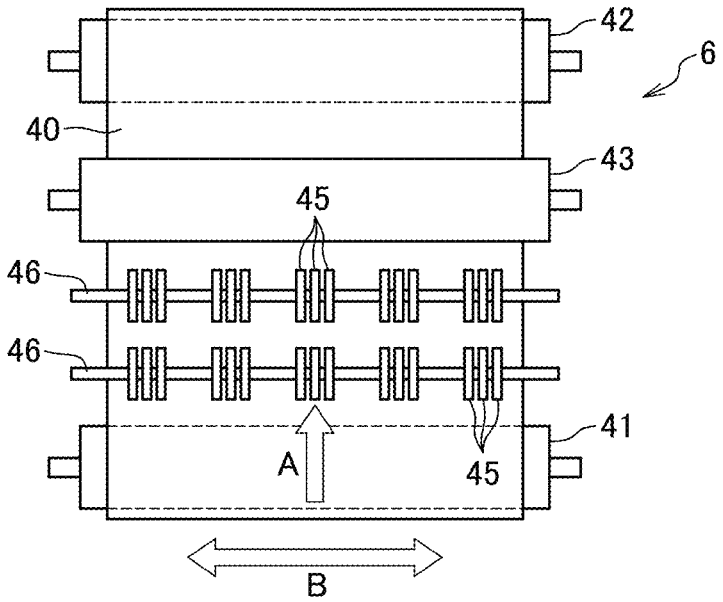
FIG. 4 is a plan view illustrating the drying device indicating another arrangement of the spur wheels.

FIG. 4 is a plan view illustrating the drying device 6 indicating another arrangement of the spur wheels 45.

Each spur wheel 45 functions as a projecting rotator having a plurality of projections projecting radially outward. The spur wheels 45 are disposed upstream from the pressure roller 43 in a sheet conveyance direction A to contact the outer circumferential surface of the heating belt 40. Further, FIG. 3 is a plan view illustrating the drying device 6 indicating the arrangement of the spur wheels 45 provided in the drying device 6 of FIG. 2. As illustrated in FIG. 3, the spur wheels 45 are mounted on a rotary shaft 46 that extends in a belt width direction indicated by arrow B in FIG. 3 or the sheet width direction. Hereinafter, the direction indicated by arrow B in FIG. 3 is referred to as the belt width direction B. Here, the "belt width direction" or the "sheet width direction" represents a direction intersecting the sheet conveyance direction A along the outer circumferential surface of the heating belt 40 and the sheet conveyance passage 22 (see FIG. 1). The plurality of spur wheels 45 may be disposed at equal intervals over the axial direction of the rotary shaft 46 (i.e., the belt width direction or the sheet width direction), as illustrated in FIG. 3 or may be disposed at different intervals. Further, FIG. 4 is a plan view illustrating the drying device 6 indicating another arrangement of the spur wheels 45. As illustrated in FIG. 4, a group of spur wheels, in which the plurality of spur wheels 45 are closely disposed to each other, may be disposed at equal intervals or different intervals over the axial direction of the rotary shaft 46 or may be disposed at different intervals. Further, the spur wheel 45 on the upstream side and the spur wheel 45 on the downstream side in the sheet conveyance direction A may not be at the same position in the sheet conveyance direction A but may be shifted from each other in the axial direction of the rotary shaft 46.

Next, a description is given of the operations of the drying device 6.

As the print job starts, the fixed roller 42 rotates in a direction indicated by arrow in FIG. 2 (that is, a counter-clockwise direction). By so doing, the heating belt 40, the tension roller 41, the pressure roller 43, and the spur wheels 45 are rotated together with the rotation of the fixed roller 42. Note that the tension roller 41 and the pressure roller 43 each may be function as a drive roller. Further, the heater 44 generates heat to heat the heating belt 40 via the tension roller 41. The heater 44 is controlled to maintain the temperature of the heating belt 40 within a range, for example, from 100° C. to 150° C.

In this state, as illustrated in FIG. 2, as the sheet P on which a liquid ink I is applied is conveyed to the drying device 6, the sheet P enters between the spur wheel 45 and the heating belt 40, so that the sheet P is conveyed by the heating belt 40 while the heating belt 40 rotates. At this time, a face of the sheet P opposite the liquid applied face Pa of the sheet P (face on which the ink I is applied) is in contact with the heating belt 40, the heat is transmitted from the heating belt 40 to the sheet P to heat the sheet P. Hereinafter, the face opposite the liquid applied face Pa of the sheet P is referred to as the opposite face Pb. This heating of the sheet P accelerates drying of the ink I on the sheet P.

Thereafter, the sheet P enters between the pressure roller 43 and the heating belt 40. While the sheet P passes the pressure roller 43, the sheet P is continuously heated, which further accelerates the drying of the ink I on the sheet P. Then, the sheet P is ejected from the drying device 6. Further, at this time, the pressure roller 43 functions to change the direction of conveyance of the sheet P to a sheet ejection direction that is different from the sheet entrance direction.

In a liquid discharge-type image forming apparatus that discharges liquid such as ink onto the sheet and forms an image on the sheet, application of liquid to the sheet may cause curling on the sheet.

Figure 5:
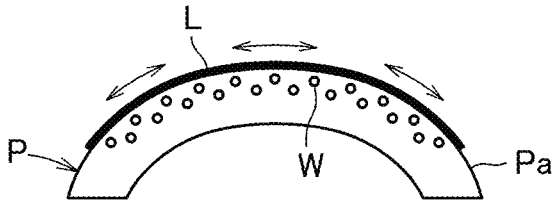
FIG. 5 is a diagram for explaining the principle of generation of a back curl on a sheet.

FIG. 5 is a diagram for explaining the principle of generation of a back curl on the sheet P.

Generally, in a case of a plain paper, when liquid L is applied to one side, that is, the liquid applied face Pa of the sheet P illustrated in FIG. 5, water W in the liquid L stretches fabric on the liquid applied face Pa of the sheet P in a specified direction, which generates a curl. More specifically, the water W permeates between the cellulose fibers of the sheet P and breaks the hydrogen bond of the cellulose fibers. By so doing, the intervals of the cellulose fibers increase, and therefore the sheet P extends in the specified direction. As a result, the sheet P warps upward to cause the liquid applied face Pa (image forming surface) to have a curl in a convex shape. The curl is referred to as a back curl.

Figure 6:
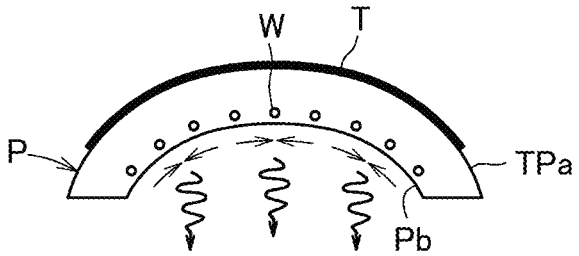
FIG. 6 is a diagram for explaining the principle of generation of another back curl on a sheet.

FIG. 6 is a diagram for explaining the principle of generation of another back curl on a sheet P.

Further, in an electrophotographic image forming apparatus that forms an image with toner, the toner applied face of the sheet is heated at the temperature higher than the temperature of the opposite face that is opposite the toner applied face of the sheet to fix the toner to the sheet. This heating may result in generation of a curl that is similar to the back curl. FIG. 6 is a diagram for explaining the principle of generation of another back curl on a sheet P. That is, as illustrated in FIG. 6, when the toner applied face TPa of the sheet P, on which toner T is applied, is heated at the high temperature, the water content of the water W originally contained in the sheet P becomes higher on the opposite face Pb than on the toner applied face TPa. Therefore, the shrinkage of the sheet P caused by the subsequent drying is more remarkable on the opposite face Pb than on the toner applied face TPa. As a result, this shrinkage causes the toner applied face TPa (image forming surface) of the sheet P to warp upward to have a back curl in a convex shape.

Generation of such a back curl on the sheet may cause inconveniences such as a conveyance failure by the sheet being caught in the middle of conveyance and an inconvenience to decrease the number of sheets stackable in the sheet ejection tray. Therefore, an embodiment of the present disclosure provides countermeasures to effectively restrain deformation of sheet such as back curl.

Hereinafter, a detailed description is given of the configuration to effectively restrain deformation of sheet in an embodiment of the present disclosure.

In the drying device 6 according to the above-described embodiment of the present disclosure, as illustrated in FIG. 2, when the sheet P is conveyed to the drying device 6, the opposite face Pb of the sheet P that is opposite the liquid applied face Pa of the sheet P contacts the heating belt 40 to heat the sheet P. That is, on the contrary to the example of a back curl illustrated in FIG. 6, the sheet P is heated from the opposite face opposite the image forming surface. By so doing, the opposite face Pb of the sheet P is heated at the temperature higher than the temperature of the liquid applied face Pa of the sheet P. Therefore, a force is exerted in the opposite direction to a force applied to the sheet P to generate the back curl. As described above, in the drying device 6 according to the present embodiment, the sheet P is heated from the opposite face Pb that is opposite the liquid applied face Pa. By so doing, the force is generated in the opposite direction to the force to generate the back curl, thereby restraining generation of the subsequent back curl.

In the drying device 6 according to the present embodiment, when the sheet P passes the pressure roller 43, the sheet P is conveyed along the curved portion 40*a* of the heating belt while the liquid applied face Pa of the sheet P is warped in the concave shape over the sheet conveyance direction A. That is, the sheet P is conveyed while being warped in a direction opposite the curve direction of the back curl. Accordingly, the sheet P hardly warps in the curve direction of the back curl, thereby restraining generation of the subsequent back curl.

Further, in the drying device 6 according to the present embodiment, when the sheet P passes the pressure roller 43, the sheet P is pressed against the heating belt 40 by the pressure roller 43 with the outer circumferential surface having the tubular shape, so that the closeness (contact area) of the sheet P to the heating belt 40 increases. Therefore, the heat is effectively transferred from the heating belt 40 to the sheet P, and drying ink on the sheet P is further accelerated. As a result, the drying device 6 restrains generation of back curl more reliably when compared with a known drying device.

Further, when a duplex printing is performed, it is preferable to dry the image on the front face of a sheet and the image on the back face of the sheet separately. That is, after the drying device 6 has dried the image on the front face of the sheet P as described above, the sheet P is switched back and conveyed in the sheet conveyance passage 25 and the sheet conveyance passage 23. Then, the sheet P is guided to the image forming device 3 via the sheet reverse passage 21. Further, the sheet P may not be conveyed in the sheet conveyance passage 25 and the sheet conveyance passage 23, but may be conveyed toward upstream from the sheet conveyance passage 22 (upstream from the drying device 6) in the sheet conveyance direction via a different sheet conveyance passage that detours the drying device 6 and may be guided to the image forming device 3 via the sheet reverse passage 21. Then, after the image forming device 3 has formed an image on the back side of the sheet P, the sheet P is conveyed to the drying device 6 again to cause the drying device 6 to perform the drying process on the image on the back face of the sheet P.

When drying the image on the back face of the sheet P, the sheet P is heated by contacting the face opposite the back face of the sheet P, that is, the front face of the sheet P, with the heating belt 40. Therefore, the sheet P is heated from the opposite face Pb (front face) opposite the liquid applied face Pa (back face) on which ink is applied before the drying process, and therefore the force is exerted in the opposite direction to the force that generates a back curl to the sheet P. Further, as the sheet P enters between the pressure roller 43 and the heating belt 40, the sheet P is warped along the pressure roller 43, so that the decurling force is applied in the opposite direction to the force that generates a back curl to the sheet P. As described above, when drying the image on the back face of the sheet P, heating the sheet P by the heating belt 40 and applying the decurling force of the pressure roller 43 to the sheet P effectively restrain deformation of the sheet P such as back curl.

Note that, since ink is applied to the front and back faces of the sheet P during the duplex printing, both the front and back faces of the sheet P may be referred to as liquid applied faces. In the present disclosure, however, when drying the ink on the back face of the sheet P after the duplex printing, the back face of the sheet P with ink before the drying process is referred to as the "liquid applied face." Therefore, the "liquid applied face" referred to in the description of the present disclosure represents the face on which liquid is applied (front face) when the sheet P has the liquid on a single face or the face on which liquid is applied for the second time (back face) when the sheet P has the liquid on both the front and back faces.

As described above, the drying device 6 according to the present embodiment heats the sheet P from the opposite face Pb that is opposite the liquid applied face Pa and warps the sheet P in the curved portion 40*a*, thereby effectively restraining generation of the back curl. Therefore, when compared with a known drying device, the drying device 6 according to the present embodiment hardly causes inconveniences such as a conveyance failure by the sheet having a back curl and a decrease in the number of sheets stackable in the sheet ejection tray.

Further, the drying device 6 according to the present embodiment also restrains cockling (waving) of the sheet as well as back curl. Even when the sheet P having cockling is conveyed to the drying device 6 according to the present embodiment, the sheet P is conveyed while the pressure roller 43 presses the sheet P. and the liquid applied face Pa of the sheet P and the opposite face Pb of the sheet P are corrected to have the same length, so that the cockling of the sheet P is restrained. As described above, the drying device 6 according to the present embodiment effectively restrains, and prevents if possible, deformation of a sheet including back curl and cockling.

Further, the drying device 6 according to the present embodiment first heats the sheet P and then ejects the sheet P. Therefore, the drying device 6 reduces the chances that the ink on the sheet P is transferred to conveyance rollers and other sheets in the subsequent process. By contrast, immediately after the sheet P is conveyed to the drying device 6, it is highly likely that ink is still in a form of liquid. Therefore, the ink may be applied to the parts disposed around the drying device 6. In the drying device 6 according to the present embodiment, however, the plurality of spur wheels 45 guides the sheet P to contact the heating belt 40 before the sheet P reaches the pressure roller 43 (on the upstream side from pressure roller 43 in the sheet conveyance direction A). Therefore, the drying device 6 heats the sheet P while reducing ink smudge (image distortion) on the sheet P. That is, even if the liquid applied face Pa of the sheet P contacts the spur w % heel 45 or the plurality of spur wheels 45, since the contact area of the spur wheel 45 or the plurality of spur wheels 45 to the liquid applied face Pa is small, ink smudge on the sheet P caused by the contact of the spur wheel 45 or the plurality of spur wheels 45 to the sheet P is prevented. Further, application of ink to the spur wheel 45 is restrained, so as to reduce smear on the sheet caused by ink being applied from the spur wheel 45 to another sheet.

As described above, the drying device 6 according to the present embodiment causes the plurality of spur wheels 45 to guide the sheet P to contact the heating belt 40 on the upstream side from the pressure roller 43 in the sheet conveyance direction A. Therefore, the ink on the sheet P is dried to a certain state (for example, to a state in which ink is not applied to another member) before the sheet P reaches the pressure roller 43. Accordingly, as described in the present embodiment, even when the pressure roller 43 having the tubular outer circumferential surface is used in order to enhance the closeness of the sheet P to the heating belt 40, application of ink to the pressure roller 43 is restrained. Therefore, deterioration in the image quality due to ink applied to the pressure roller 43 and smear on the sheet P due to ink being applied from the pressure roller 43 to another sheet are reduced.

In addition, in the drying device 6 according to the present embodiment, the heater 44 is disposed upstream from the pressure roller 43 (or the curved portion 40*a* in which the pressure roller 43 contact the heating belt 40) in the sheet conveyance direction A. Therefore, the sheet P is effectively heated on the upstream side from the pressure roller 43 in the sheet conveyance direction A. Accordingly, the drying of the ink on the sheet P is accelerated before the sheet P reaches the pressure roller 43 and ink application to the pressure roller 43 is restrained effectively.

In order to further restrain ink application to the pressure roller 43, a roller having the uneven outer circumferential surface, in other words, having convex and concave portions on the outer circumferential surface may be employed to reduce the contact area of the pressure roller 43 to the sheet P.

Figure 7:
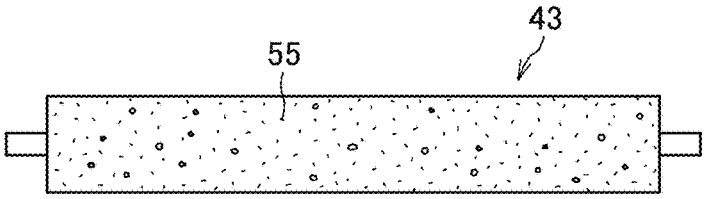
FIG. 7 is a diagram illustrating an example of a pressure roller employing an abrasive roller.

FIG. 7 is a diagram illustrating an example of the pressure roller 43 employing an abrasive roller.

Figure 8:
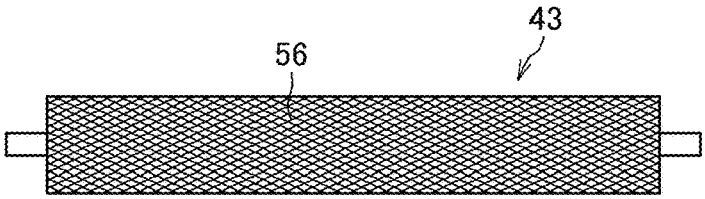
FIG. 8 is a diagram illustrating an example of a pressure roller employing a knurl roller.

FIG. 8 is a diagram illustrating an example of the pressure roller 43 employing a knurl roller.

For example, the pressure roller 43 may employ an abrasive roller having the outer circumferential surface on which abrasive grains 55 such as a plurality of ceramic or glass are attached, as illustrated in FIG. 7. Alternatively, the pressure roller 43 may employ a knurl roller having the outer circumferential surface on which meshed convex-concave portions (knurling) 56 are provided, as illustrated in FIG. 8.

Further, in the drying device 6 according to the present embodiment, the spur wheel or the plurality of spur wheels 45 conveys the sheet P while contacting the sheet P to the surface of the heating belt 40. Therefore, waving of the sheet P is reduced to cause the sheet P to enter between the pressure roller 43 and the heating belt 40. Accordingly, wrinkles that are likely to be generated when the sheet P is gripped and held by the pressure roller 43 and the heating belt 40 may be reduced.

Further, in the drying device 6 according to the present embodiment, the sheet P is not strongly pressed on the heating belt 40 before the sheet P reaches the pressure roller 43. Therefore, occurrence of wrinkles of the sheet P is reduced more effectively. That is, in the present embodiment, the pressure roller 43 and the tension roller 41 are spaced away from each other relative to the heating belt 40 in the sheet conveyance direction A and contact the heating belt 40 separately. Therefore, a nip region in which the sheet P is strongly pressed by the pressure roller 43 and the tension roller 41 is not formed. In addition, each spur wheel 45 is disposed upstream from the pressure roller 43 in the sheet conveyance direction A and simply contacts the heating belt 40 without pressing the heating belt 40. Therefore, the sheet P is not pressed by the spur wheel 45 or the plurality of spur wheels 45. Further, in the drying device 6 according to the present embodiment, the sheet P is not strongly pressed by the pressure roller 43 and the tension roller 41 and is conveyed by the plurality of spur wheels while being held in a flat shape on the heating belt 40. Therefore, the sheet P enters in a flat shape between the pressure roller 43 and the heating belt 40, thereby restraining occurrence of wrinkles on the sheet P.

Note that the plurality of spur wheels 45 may not contact the outer circumferential surface of the heating belt 40. As long as the sheet P is conveyed while being held in a flat shape without waving on the heating belt 40, the spur wheel 45 or the plurality of spur wheels may be disposed close to the outer circumferential surface of the heating belt 40 (indirectly contacting the outer circumferential surface of the heating belt 40 via a gap). In other words, as long as a good conveyability of sheets is obtained, the spur wheel 45 or the plurality of spur wheels 45 may be in contact with the heating belt 40 or without contacting the heating belt 40 and may be at least disposed facing the outer circumferential surface of the heating belt 40.

Figure 9:
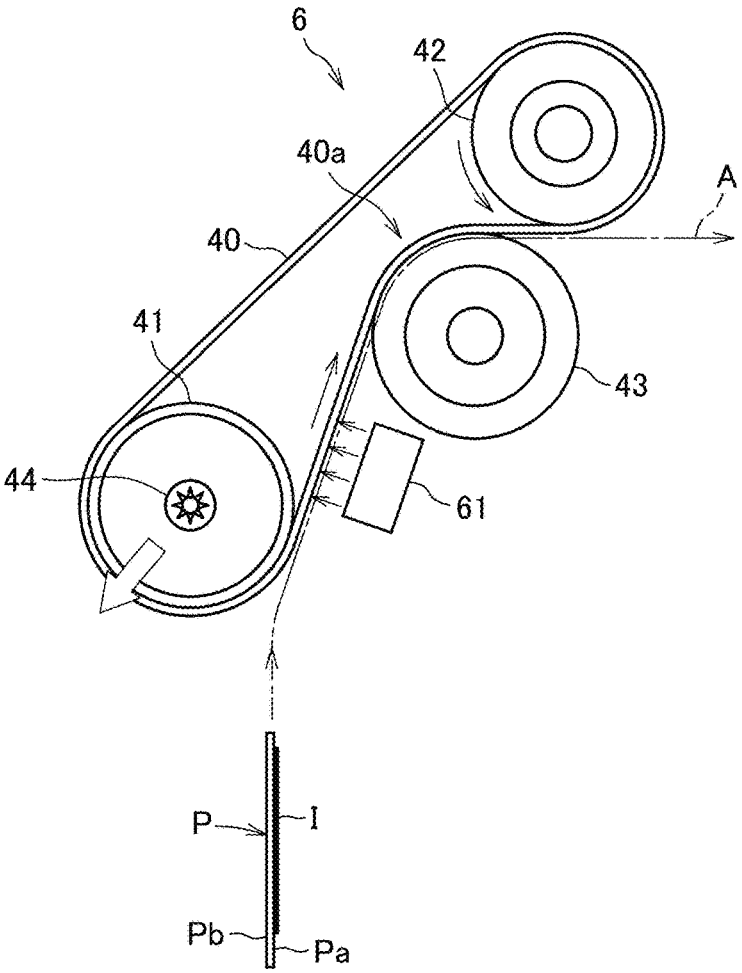
FIG. 9 is a diagram illustrating an example of an air blowing fan instead of the spur wheels.

FIG. 9 is a diagram illustrating an example of an air blowing fan instead of the spur wheels 45.

That is, as illustrated in FIG. 9, instead of the spur wheel 45, an air blowing fan 61 that functions as an air blower may be employed. In this case, the air blowing fan 61 blows air to cause the sheet P to contact the heating belt 40. By so doing, the sheet P is conveyed while being held in a flat shape without being pressed strongly. Further, the air blowing fan 61 may be a warm air blowing fan that blows warm air to restrain the heating belt 40 from being cooled.

Further, instead of the spur wheel 45, the heating belt 40 may be charged, so that the sheet P is electrostatically attracted to the heating belt 40.

Figure 10:
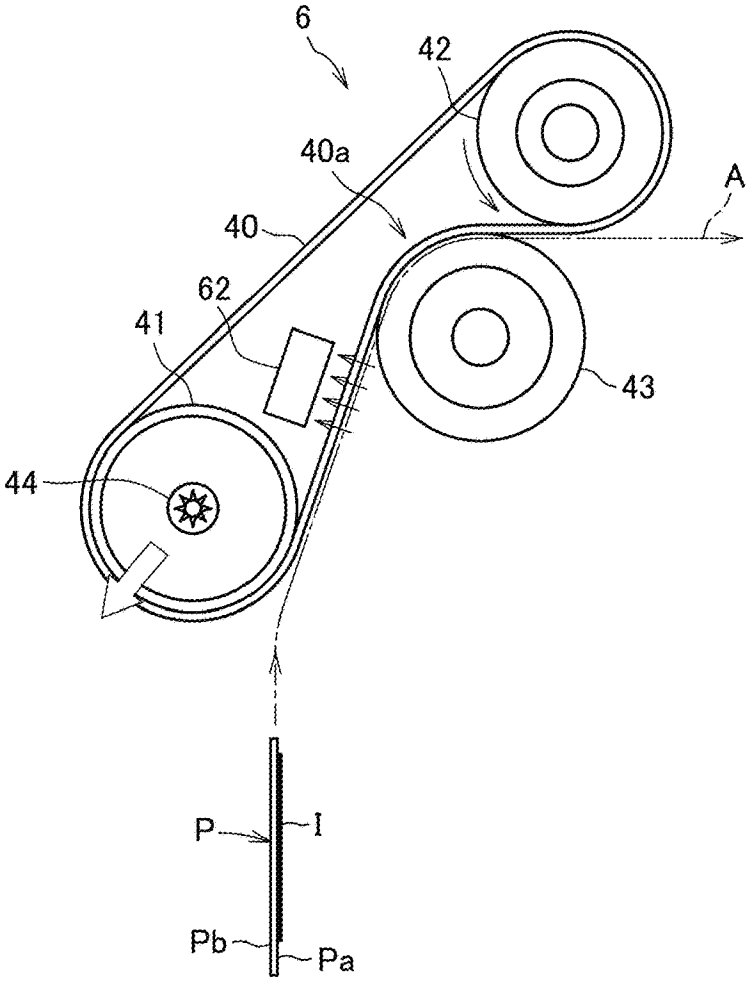
FIG. 10 is a diagram illustrating an example of an air suction fan instead of the spur wheels.

Further, FIG. 10 is a diagram illustrating an example of an air suction fan instead of the spur wheels.

Figure 11:
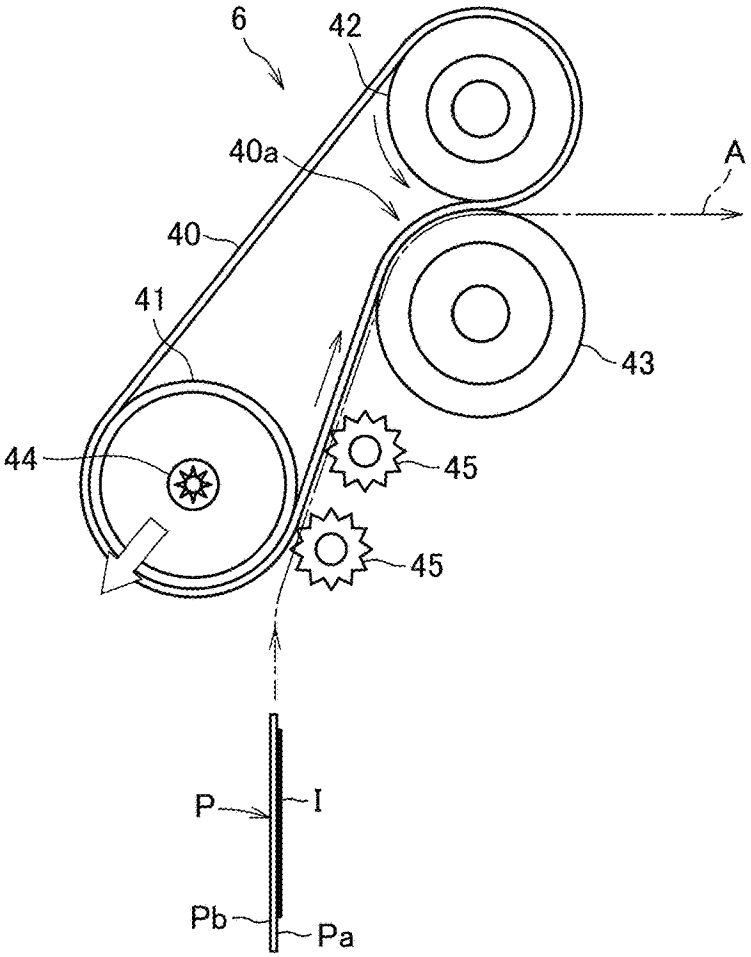
FIG. 11 is a diagram illustrating an example that the pressure roller contacts a fixed roller via a heating belt.

FIG. 11 is a diagram illustrating an example that the pressure roller 43 contacts the fixed roller 42 via the heating belt 40.

Figure 12:
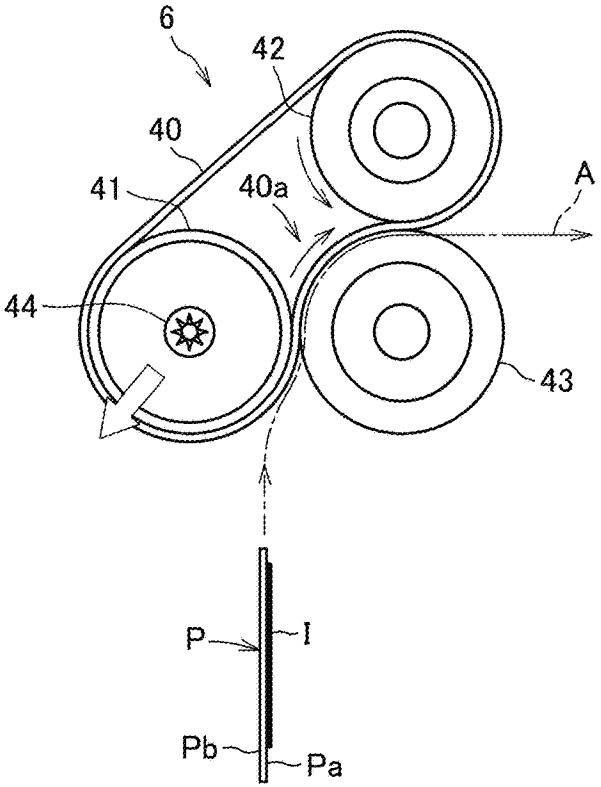
FIG. 12 is a diagram illustrating an example that the pressure roller contacts a tension roller and the fixed roller via the heating belt.

FIG. 12 is a diagram illustrating an example that the pressure roller 43 contacts the tension roller 41 and the fixed roller 42 via the heating belt 40.

To be more specific, as yet another example, as illustrated in FIG. 10, an air suction fan 62 may be disposed inside the loop of the heating belt 40. In this case, the heating belt has a plurality of air holes and the air suction fan 62 sucks air from the plurality of air holes of the heating belt 40. By so doing, the sheet P is attracted to the heating belt 40. In this case, the air suction fan 62 sucks air to convey the sheet P while being held in a flat shape without being pressed strongly.

Further, in the drying device 6 according to the present embodiment, the sheet P is not strongly pressed on the heating belt 40 before the sheet P reaches the pressure roller 43. Therefore, occurrence of wrinkles of the sheet P caused when the sheet P is strongly pressed is restrained. In particular, in a state in which the sheet P is wet by ink, wrinkles may occur easily if the sheet P is strongly pressed. Therefore, the sheet P is needed not to be pressed strongly against the heating belt 40, on the upstream side in the sheet conveyance direction A on which the ink on the sheet P is not completely dried. Therefore, for example, it is more preferable that the nip region in which the tension roller 41 and a roller facing the tension roller 41 contact (press against) each other via the heating belt 40 is not formed.

On the other hand, the pressure roller 43 may not contact (press) the fixed roller 42 via the heating belt 40 (as illustrated in FIGS. 2, 9, and 10) or may contact the fixed roller 42 via the heating belt 40 (as illustrated in FIG. 11). Further, in order to restrain deformation of the sheet such as back curl more effectively, as illustrated in FIG. 12, the pressure roller 43 may contact both the tension roller 41 and the fixed roller 42 via the heating belt 40.

In particular, in a case of the example illustrated in FIGS. 2, 9, and 10, the pressure roller 43 is disposed not to contact the tension roller 41 and the fixed roller 42 via the heating belt 40. In other words, the pressure roller 43 is disposed spaced away from the tension roller 41 and the fixed roller 42 in the sheet conveyance direction A and is in contact with the heating belt 40 separately. Therefore, it is more difficult to generate wrinkles of the sheet P.

Further, as illustrated in FIGS. 2, 9, and 10, when the pressure roller 43 is disposed not to contact (press) the tension roller 41 and the fixed roller 42 via the heating belt 40, the load to be applied to the heating belt 40 when the pressure roller 43 presses the heating belt 40 is also reduced. Accordingly, damage and abrasion to the heating belt 40 are restrained, and therefore the durability of the heating belt 40 is enhanced and the long service life of the heating belt 40 is achieved. Further, the rotational resistance of the heating belt 40 is reduced, and therefore the efficiency of rotation of the heating belt 40 increases and the driving energy is saved.

Figure 13:
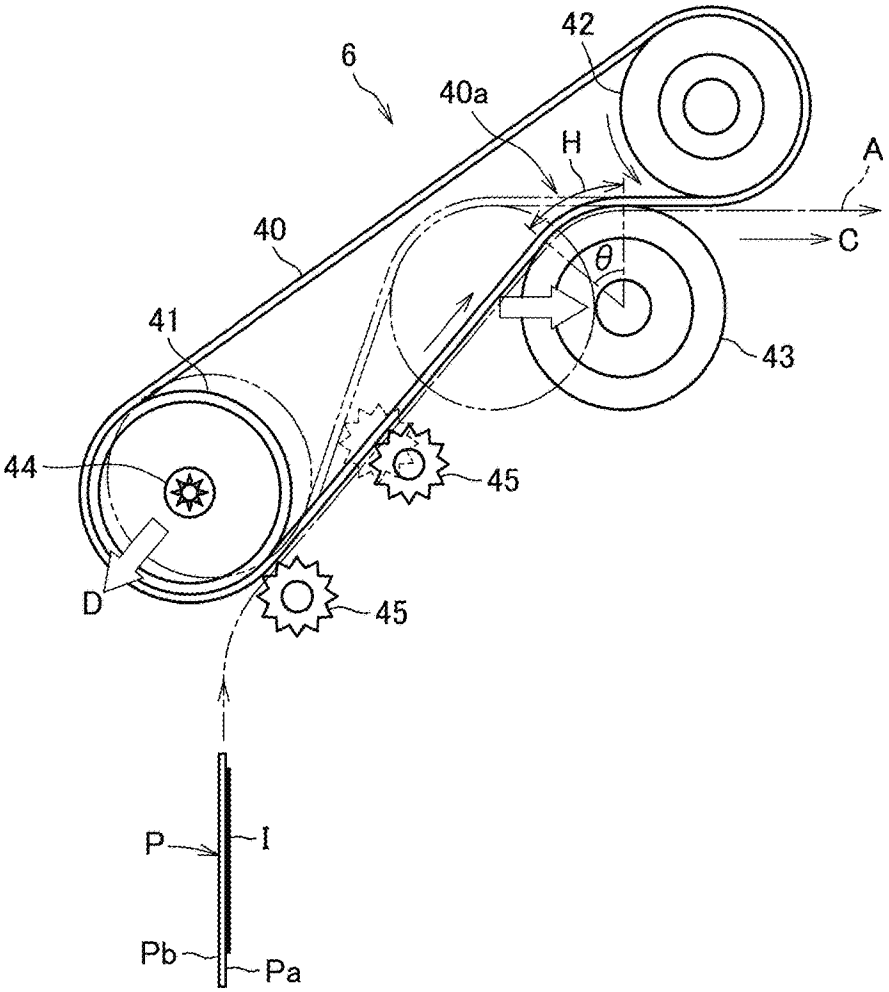
FIG. 13 is a diagram illustrating an example that the winding angle of the heating belt around the pressure roller is changeable.

FIG. 13 is a diagram illustrating an example that the winding angle of the heating belt 40 around the pressure roller 43 is changeable.

As illustrated in FIG. 13, the pressure roller 43 may be moved to change the winding angle θ of the heating belt 40 to the pressure roller 43. Accordingly, the length H of the contact area (curved portion 40*a*) in the sheet conveyance direction A in which the pressure roller 43 and the heating belt 40 contact is changeable.

To be more specific, when an image having a low coverage rate with texts, for example, the amount of ink application to the sheet P is relatively small, and therefore it is not likely to generate back curl easily. Therefore, when an image having a low coverage rate is formed on the sheet P, as illustrated in FIG. 13, the pressure roller 43 is moved to the right direction in FIG. 13 to reduce the winding angle θ of the heating belt 40 to the pressure roller 43, so as to reduce the length H of the contact area in the sheet conveyance direction A. In this case, a decurling action when the sheet P passes the curved portion 40*a* of the heating belt is decreased to apply a decurling force corresponding to the amount of curl of a possible back curl. Further, in this case, a reduction in the length H of the contact area of the pressure roller 43 and the heating belt 40 in the sheet conveyance direction A decreases the time to heat the sheet P while the sheet P is pressed against the heating belt 40 by the pressure roller 43. However, the sheet P having the low coverage rate and the low amount of ink application takes a shorter time to heat the sheet P for drying, and therefore the winding angle θ of the heating belt may be small. Further, in this case, the amount of heat to be applied to the sheet P from the heating belt 40 decreases, the energy-saving performance is enhanced.

By contrast, when an image having a high rate and a high amount of ink application is formed, the pressure roller 43 is moved to the left side in FIG. 13 to increase the winding angle θ of the heating belt 40 to the pressure roller 43, so as to increase the length H of the contact area in the sheet conveyance direction A. Accordingly, the decurling action when the sheet P passes the curved portion 40*a* of the heating belt 40 is increased to effectively restrain deformation of the sheet such as back curl.

Further, when a relatively thick sheet P such as a thick paper is conveyed, if the winding angle θ is large, it is difficult to warp and convey the sheet P. Therefore, it is preferable to make the winding angle θ relatively small. By making the winding angle θ relatively small, even when the thick sheet P is conveyed, the sheet P is smoothly conveyed, and therefore occurrence of a conveyance failure may be prevented. As described above, by accordingly changing the winding angle θ depending on the thickness of the sheet and the amount of ink application to the above-described sheet, deformation of the sheet is effectively restrained, and the conveyance performance and the energy-saving performance are enhanced.

Further, in order to enhance the energy-saving performance, the amount of heat generation of the heater 44 may be controlled according to the amount of ink application to the sheet P. That is, when the amount of ink application to the sheet P is small, the time to heat the sheet P for drying may be short. Therefore, by reducing the amount of heat generation of the heater 44, the energy-saving performance is more enhanced when compared with a case in which the amount of ink application to the sheet P is large.

Further, as illustrated in FIG. 13, it is preferable that the direction of movement of the pressure roller 43 is parallel to the direction of the heating belt 40 extending toward downstream from the pressure roller 43 in the sheet conveyance direction A (i.e., the direction indicated by arrow C in FIG. 13). By so doing, even when the pressure roller 43 is moved, the sheet ejection direction of the sheet P from the drying device 6 may not be changed, thereby ejecting the sheet P reliably.

Further, as illustrated in FIG. 13, as the pressure roller 43 moves, the tension roller 41 moves together with the pressure roller 43, so that the tension applied to the heating belt 40 is adjusted to the predetermined value. At this time, by setting the direction of movement of the tension roller 41 to the direction obliquely downward to the left (direction indicated by arrow D in FIG. 13) and the direction opposite the direction obliquely downward to the left, the spur wheel 45 at the extreme upstream position in the sheet conveyance direction A and the heating belt 40 are continuously in contact with each other and maintain the contact state without moving the spur wheel 45 at the extreme upstream position. Accordingly, the entrance position and entrance angle at which the sheet P enters between the extreme upstream spur wheel 45 and the heating belt 40 in the sheet conveyance direction A do not change, and the entrance of the sheet P may be made reliably.

Figure 14:
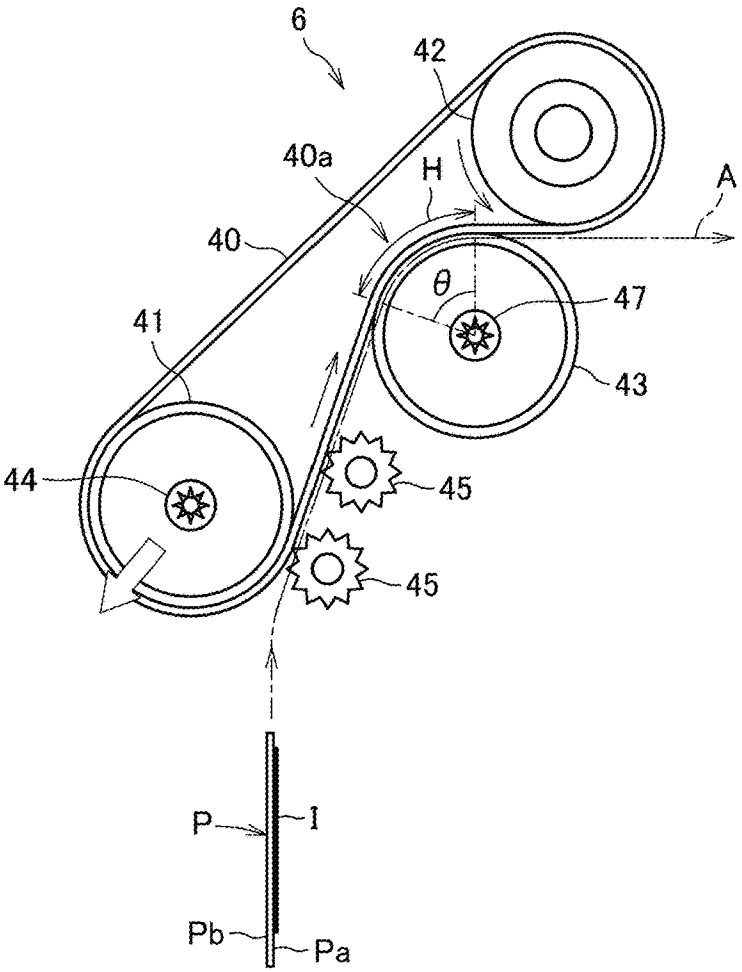
FIG. 14 is a diagram illustrating a configuration of the drying device according to another embodiment of the present disclosure.

FIG. 14 is a diagram illustrating the configuration of the drying device 6 according to another embodiment of the present disclosure.

The drying device 6 illustrated in FIG. 14 includes a heater 47 that is a heater different from the heater 44 that is provided in the tension roller 41. The heater 47 functions as a hear source disposed inside the pressure roller 43 to heat the pressure roller 43. The drying device 6 illustrated in FIG. 14 basically has the configuration identical to the configuration of the drying device 6 illustrated in FIG. 2, except that the heater 47 in FIG. 14 is disposed in the pressure roller 43 while the heater 44 in FIG. 2 is disposed in the tension roller 41.

In this case, the pressure roller 43 functions as a pressing member that presses the sheet P and as a heating member (heat rotator) that heats the sheet P. Therefore, when the sheet P passes the pressure roller 43, the sheet P is heated from the face that contacts the heating belt 40 (i.e., the opposite face Pb opposite the liquid applied face Pa) and the face that contacts the pressure roller 43 (i.e., the liquid applied face Pa) at the same time. Accordingly, the sheet P is heated effectively, and the drying of ink on the sheet P is further accelerated.

Further, in this case, the heat is applied to the face that contacts the heating belt 40 (i.e., the opposite face Pb opposite the liquid applied face Pa) longer than the face that contacts the pressure roller 43 (i.e., the liquid applied face Pa). Therefore, as the above-described embodiment, the opposite face Pb opposite the liquid applied face Pa of the sheet P is heated at the temperature higher than the temperature to the liquid applied face Pa. Accordingly, in the present embodiment, the force is exerted in the opposite direction opposite the force to generate a back curl on the sheet P, thereby restraining generation of the back curl. Further, in order to restrain generation of back curl more effectively, heat generation by the heater 44 and the heater 47 may be controlled to set the temperature of the heating belt 40 to be higher than the temperature of the pressure roller 43.

Further, when performing the duplex printing, as the above-described embodiment, after the drying device 6 has dried the ink on the front face of the sheet P, an image is formed on the back face of the sheet P. Then, the sheet P may be conveyed to the drying device 6 again to dry the ink on the back face of the sheet P. Alternatively, after images have been formed on both the front and back faces of the sheet P, the sheet P may be conveyed to the drying device 6 to dry the ink on the front and back faces of the sheet P simultaneously.

Further, the structure in which the heater 47 is disposed inside the pressure roller 43 may allow the pressure roller 43 to move, as illustrated in FIG. 13, so as to change the winding angle θ of the heating belt 40 to the pressure roller 43 and the length H of the contact area (curved portion 40*a*) in the sheet conveyance direction A in which the pressure roller 43 and the heating belt 40 contact. Further, the amount of heat generation of at least one of the heater 44 inside the tension roller 41 and the heater 47 inside the pressure roller 43 may be controlled according to the amount of ink application to the sheet P. To be more specific, the amount of heat generation of the heater 44 inside the tension roller 41, the amount of heat generation of the heater 47 inside the pressure roller 43, or both may be controlled according to the amount of ink application to the sheet P.

Figure 15:
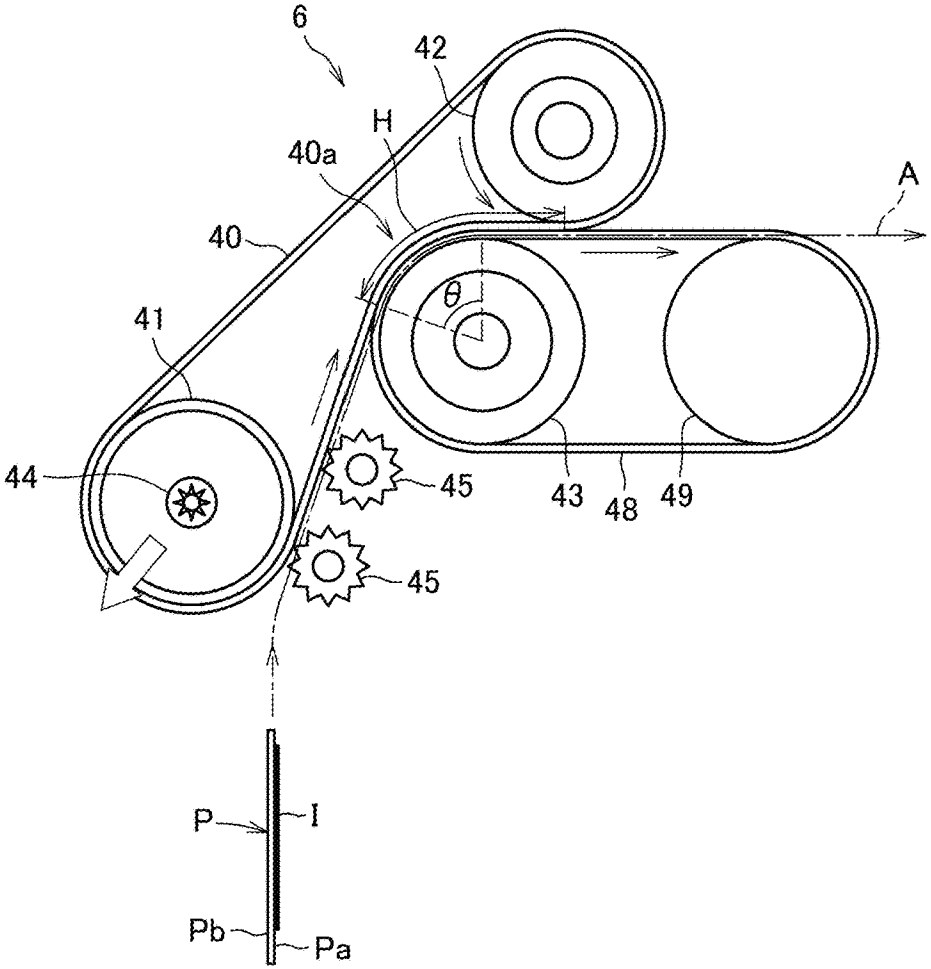
FIG. 15 is a diagram illustrating a configuration of the drying device according to yet another embodiment of the present disclosure.

FIG. 15 is a diagram illustrating a configuration of the drying device 6 according to yet another embodiment of the present disclosure.

The drying device 6 illustrated in FIG. 15 includes a pressure belt 48 that includes an endless belt. The pressure belt 48 is wound around the pressure roller 43. Further, the drying device 6 further includes a support roller 49 in addition to the pressure roller 43. The support roller 49 functions as a belt support to rotatably support the pressure belt 48. The drying device 6 illustrated in FIG. 14 basically has the configuration identical to the configuration of the drying device 6 illustrated in FIG. 2, except that the heater 47 in FIG. 14 is disposed in the pressure roller 43 while the heater 44 in FIG. 2 is disposed in the tension roller 41.

In the drying device 6 according to the present embodiment, since pressure roller 43 is biased toward the heating belt 40 via the pressure belt 48, the pressure belt 48 is pressed against the heating belt 40. That is, in the present embodiment, the pressure roller 43 and the pressure belt 48 each of which functions as a pressing member to press the heating belt 40. Further, in the present embodiment, as the fixed roller 42 is driven to rotate, the heating belt 40, the tension roller 41, the pressure belt 48, the pressure roller 43, and the support roller 49 are rotated along with rotation of the fixed roller 42. Further, either the pressure roller 43 or the support roller 49 may function as a drive roller.

In the drying device 6 according to the present embodiment, as the sheet P passes the spur wheels 45 and enters between the heating belt 40 and the pressure belt 48, the sheet P is conveyed by the heating belt 40 and the pressure belt 48 while the heating belt 40 and the pressure belt 48 are rotating and pressing the sheet P. At this time, the sheet P is warped in the direction opposite the curve direction of the back curl along the curved portion 40*a* of the heating belt 40. Therefore, occurrence of back curl is restrained effectively. Further, the drying device 6 according to the present embodiment employs two belts (the heating belt 40 and pressure belt 48) which are in contact with each other to convey the sheet P while gripping (holding) the sheet P. Therefore, the area in which the two belts convey the sheet P while gripping (holding) the sheet P (i.e., the area indicated by H in FIG. 15) extends largely in the sheet conveyance direction A. Consequently, the sheet P is heated effectively. Accordingly, the drying device 6 according to the present embodiment further accelerates the drying of ink on the sheet P, and therefore effectively restrains, and prevents if possible, deformation of a sheet such as back curl.

In addition, in the drying device 6 according to the present embodiment, the pressure belt 48 is disposed to extend not to the upstream side but to the downstream side from the curved portion 40*a* in the sheet conveyance direction A, thereby restraining the ink application to the pressure belt 48. That is, the sheet P is heated while being guided by the spur wheel or the plurality of spur wheels 45 on the upstream side from the curved portion 40*a* in the sheet conveyance direction A. Therefore, even if the sheet P contacts the pressure belt 48 after the sheet P is heated on the upstream side, the ink application to the pressure belt 48 is restrained.

Figure 16:
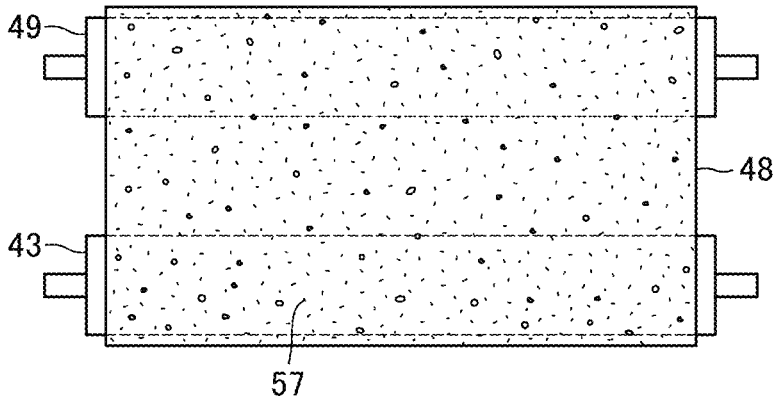
FIG. 16 is a diagram illustrating an example that the outer circumferential surface of a pressing belt has fine surface asperities.
Figure 17:
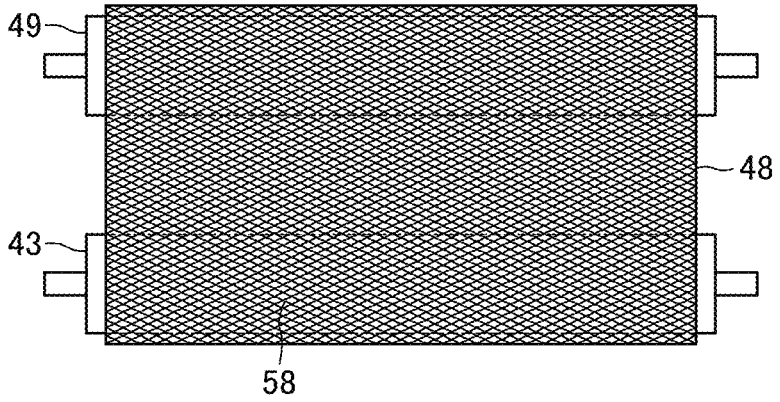
FIG. 17 is a diagram illustrating an example that the pressing belt has a mesh pattern.

FIG. 16 is a diagram illustrating an example that the outer circumferential surface of the pre a pressing belt has fine surface asperities FIG. 17 is a diagram illustrating an example that the pressing belt has a mesh pattern.

The pressure belt 48 may include a belt 57 having the uneven outer circumferential surface, in other words, having fine asperities on the outer circumferential surface, as illustrated in FIG. 16, or a belt 58 having a mesh pattern, as illustrated in FIG. 17, may be employed in order to restrain ink application to the pressure belt 48 more effectively.

Further, as the example of FIG. 13, the drying device 6 illustrated in FIG. 15 may allow the pressure roller 43 to move according to the amount of ink application to the sheet P. According to this configuration, the winding angle θ of the heating belt 40 to the pressure belt 48 is changed to change the length H of the contact area in the sheet conveyance direction A in which the pressure belt 48 and the heating belt 40 contact with each other. Further, the amount of heat generation of the heater 47 may be controlled according to the amount of ink application to the sheet P. Further, a heater may be provided in the pressure roller 43 to heat the sheet P from the front and back faces of the sheet P.

Further, the drying device (heating device) according to the present disclosure is not limited to each of the above-described embodiments and variation.

Figure 18:
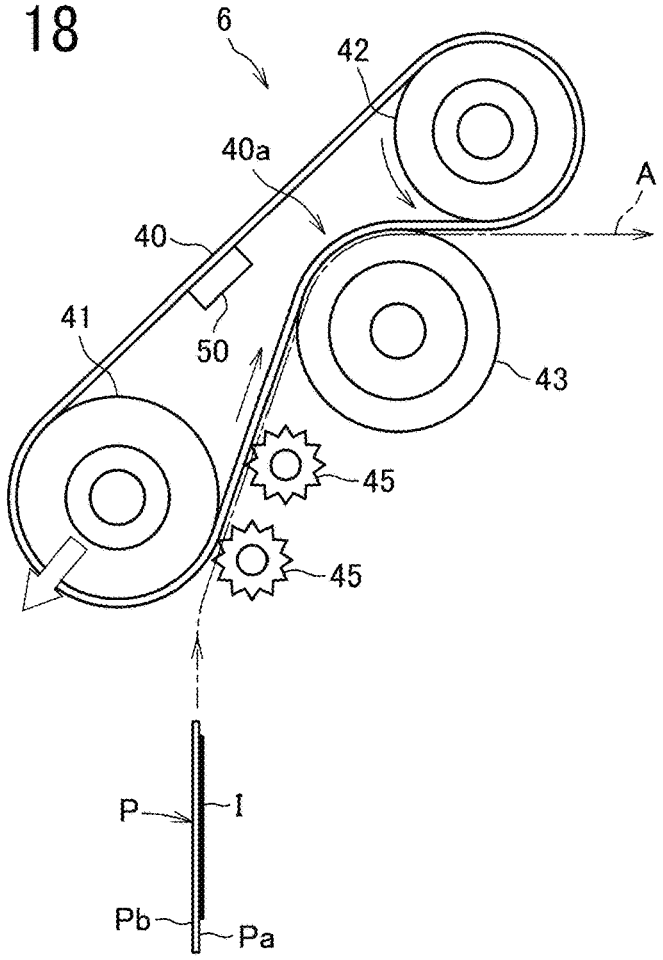
FIG. 18 is a diagram illustrating an example that a ceramic heater functioning as a heat source is employed to contact the heating belt.

FIG. 18 is a diagram illustrating an example that a ceramic heater functioning as a heat source is employed to contact the heating belt 40.

For example, the heat source to heat the heating belt 40 is not limited to a member disposed inside the roller (i.e., the tension roller 41 and the fixed roller 42) that stretches the heating belt 40 but may be disposed to contact the inner circumferential surface of the heating belt 40, as illustrated in FIG. 18 (for example, a ceramic heater 50). Further, a ceramic heater may also be disposed in contact with the pressure belt 48 illustrated in FIG. 15. Further, the ceramic heater 50 may be disposed to contact the outer circumferential surface of the belt (i.e., the heating belt 40 and the pressure belt 48) as well as the inner circumferential surface of the belt. However, since the ceramic heater 50 relatively slides on the belt while the belt is rotating, in order to reduce the sliding resistance at this time, it is preferable that a slide sheet including a low friction material may be inserted between the ceramic heater 50 and the belt or a sheet metal such as aluminum having a slide coating to enhance the thermal conductivity efficiency.

Figure 19:
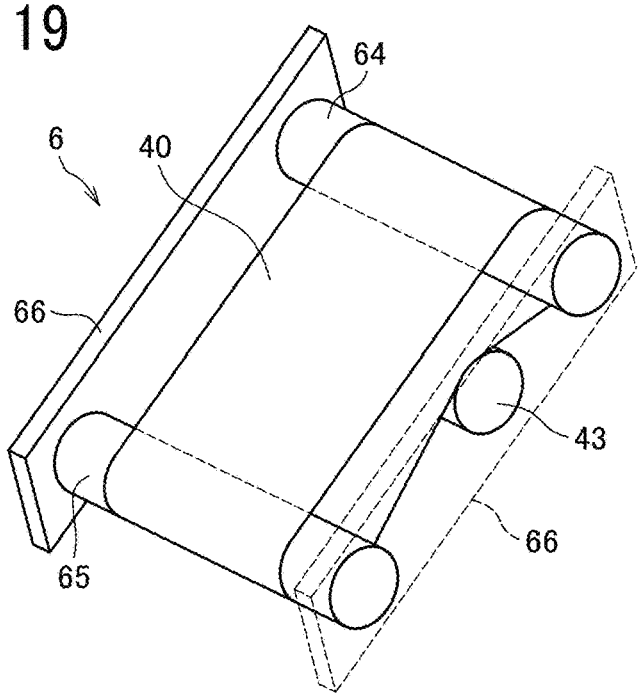
FIG. 19 is a diagram illustrating an example that the heating belt is supported by a belt support that does not rotate.

Further, FIG. 19 is a diagram illustrating an example that the heating belt 40 is supported by a belt support that does not rotate.

In the drying device (heating device) according to the present disclosure, the belt support that supports the heating belt 40 is not limited to a rotary body such as the tension roller 41 and the fixed roller 42. For example, as illustrated in FIG. 19, the heating belt 40 may be supported by a plurality of belt supports, which are a belt support 64 and a belt support 65. The belt supports 64 and 65 do not rotate. In this case, as the pressure roller 43 is driven to rotate, the heating belt 40 is rotated along with rotation of the pressure roller 43 while sliding on the belt supports 64 and 65. Therefore, it is preferable that each of the belt supports 64 and 65 includes a low friction material in order to reduce this sliding resistance of the heating belt 40. Alternatively, a slide sheet that includes a low friction material may be provided between the heating belt 40 and the belt support 64 and between the heating belt 40 and the belt support 65. Further, each of the belt supports 64 and 65 may be constructed as separate parts or may be constructed as a single unit via a pair of frame members 66 illustrated in FIG. 19.

Figure 20:
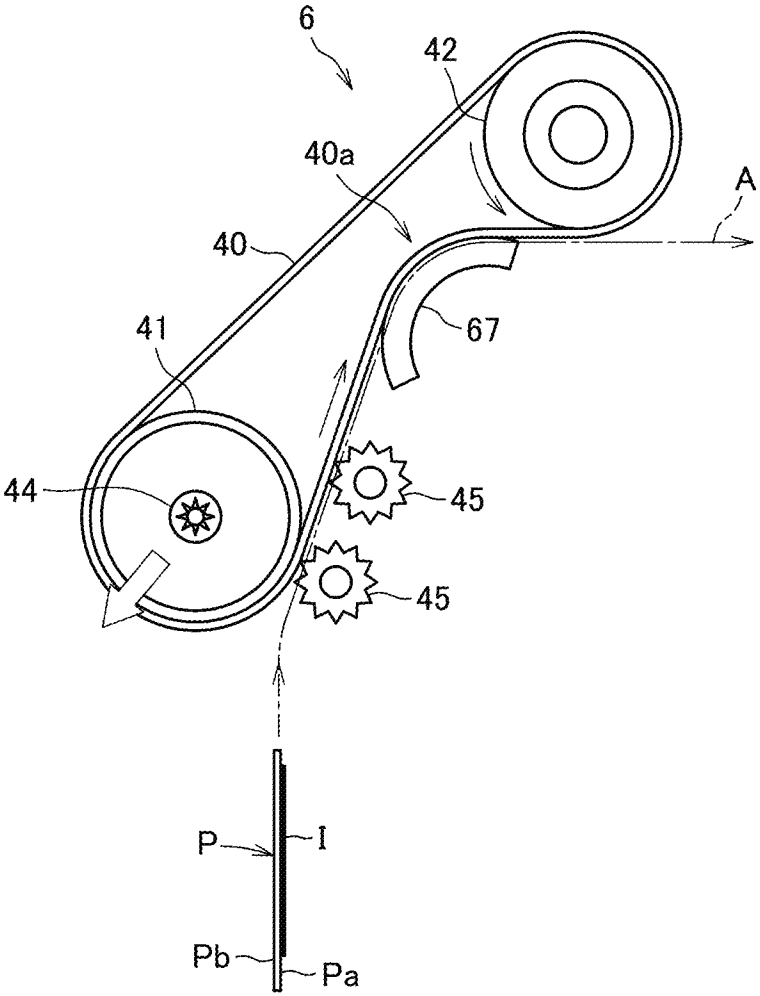
FIG. 20 is a diagram illustrating an example that a pressing pad that does not rotate is employed as a pressing member.

Further, FIG. 20 is a diagram illustrating an example that a pressing pad that does not rotate is employed as a pressing member.

In the drying device (heating device) according to the present disclosure, a pressing member that presses the heating belt 40 is not limited to a rotary body such as the pressure roller 43. For example, in a case in which the liquid to be applied to the sheet is a processing liquid that does not form an image, even if the pressing member does not rotate along with the sheet, no problem of smear of the image does not occur. In such a case, as illustrated in FIG. 20, the pressing member may be a pressing pad 67. The pressing pad 67 includes a ceramic heater having a curved surface and does not rotate. In this case, it is preferable to insert a slide sheet that includes a low friction material, between the heating belt 40 and the pressing pad 67, in order to reduce the sliding resistance that is generated between the heating belt 40 and the pressing pad 67.

Further, in the drying device (heating device) according to the present disclosure, the heating member to heat the sheet P is not limited to a rotary body such as the heating belt 40.

Figure 21:
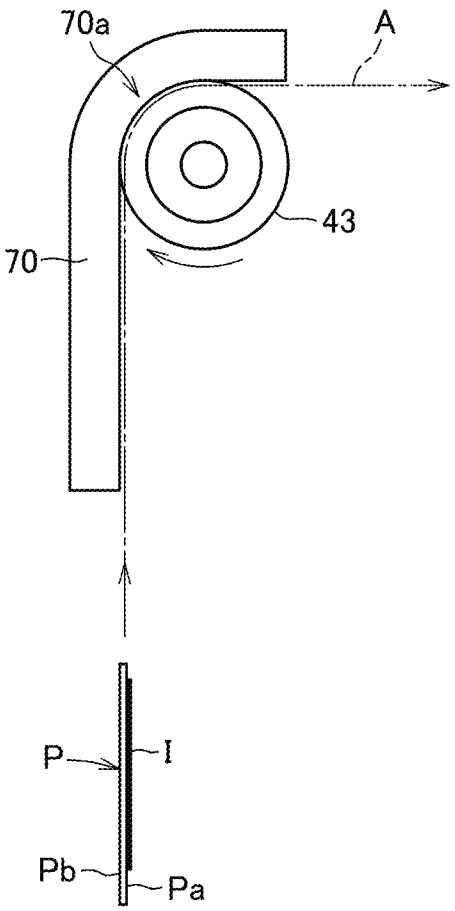
FIG. 21 is a diagram illustrating an example that a heating guide that does not rotate is employed as a heating member.

FIG. 21 is a diagram illustrating an example that a heat guide that does not rotate is employed as a heating member.

As illustrated in FIG. 21, for example, the heating member may be a heat guide 70 that does not rotate. The heat guide 70 includes a curved portion 70*a* along which the sheet P is warped. In this case, as the pressure roller 43 is driven to rotate, the sheet P is conveyed while the opposite face Pb of the sheet P opposite the liquid applied face Pa of the sheet P contacts the heat guide 70. Further, the sheet P passes along the curved portion 70*a* of the heat guide 70 while the liquid applied face Pa of the sheet P is warped in a concave shape in the curved portion 70*a* over the sheet conveyance direction A. By so doing, the opposite face Pb of the sheet P is heated at the temperature higher than the temperature of the liquid applied face Pa of the sheet P and the sheet P is warped in the direction opposite the curve direction of the back curl. Therefore, as the above-described embodiment, deformation of the sheet P such as back curl is restrained effectively.

Figure 22:
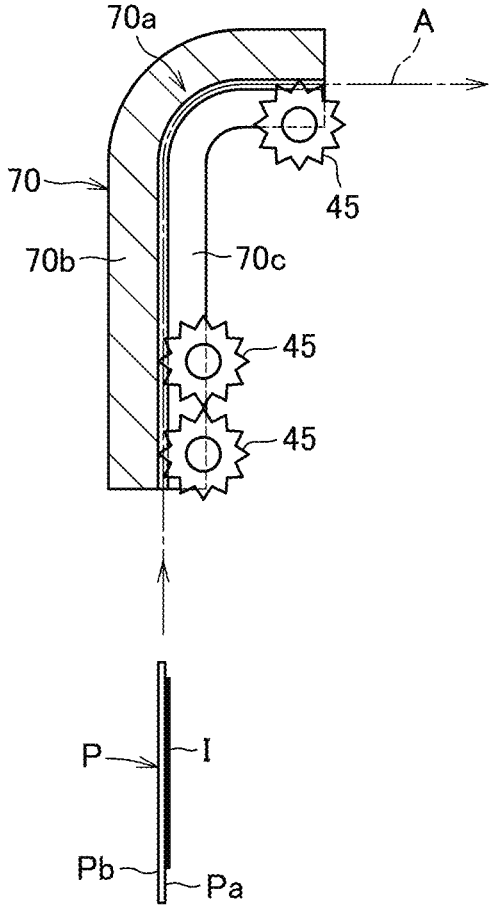
FIG. 22 is a diagram illustrating a heating guide according to Variation.

Further, FIG. 22 is a diagram illustrating a heat guide according to Variation.

Specifically, the configuration of the heat guide 70 is not limited to the configuration depicted in FIG. 21 but the configuration of the heat guide 70 may be the configuration depicted in FIG. 22. Note that the configuration illustrated in FIG. 22 is different from the configuration illustrated in FIG. 21 in that the pressure roller 43 is not provided in the curved portion 70*a* of the heat guide 70 but the spur wheels 45 are provided upstream and downstream from the heat guide 70 in the sheet conveyance direction A.

Figure 23:
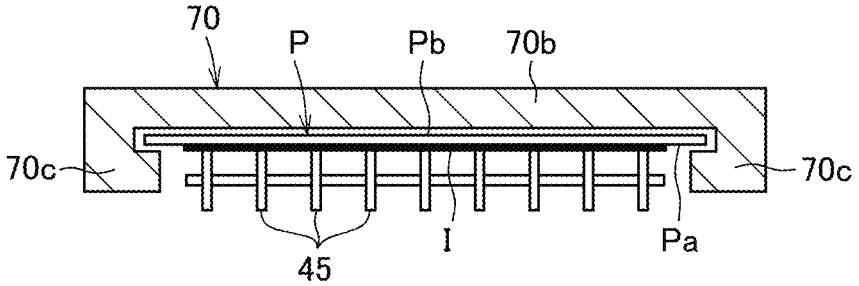
FIG. 23 is a cross sectional view of the heating guide of FIG. 22 in the width direction of the sheet.

FIG. 23 is a cross sectional view of the heat guide 70 of FIG. 22 in the width direction of the sheet P, in other words, in the sheet width direction that intersects with the sheet conveyance direction A along the sheet conveyance passage.

As illustrated in FIG. 23, the heat guide 70 includes a main guide portion 70*b* and a pair of end guide portions 70*c*. The main guide portion 70*b* is disposed over the entire width direction of the sheet P. The end guide portions 70*c* are disposed at both ends in the width direction of the sheet P. The main guide portion 70*b* is disposed on the same side as the opposite face Pb opposite the liquid applied face Pa of the sheet P. On the other hand, each end guide portion 70*c* is disposed at the end in the width direction of the sheet P, on the side facing the liquid applied face Pa of the sheet P. Each spur wheel 45 is disposed between the pair of end guide portions 70*c*.

In a case of this embodiment, as the sheet P is conveyed to the heat guide 70, both ends in the width direction of the sheet P enter between the main guide portion 70*b* and each end guide portion 70*c*, so that the sheet P is guided by the main guide portion 70*b* and the end guide portions 70*c*. Further, the sheet P is conveyed while being held by the main guide portion 70*b* and the spur wheel 45 on the upstream side in the sheet conveyance direction A. Then, the sheet P passes the curved portion 70*a* of the heat guide 70. Thereafter, the sheet P is held and conveyed by the main guide portion 70*b* and the spur wheel 45 on the downstream side in the sheet conveyance direction A. and eventually the sheet is ejected. Also, in this case, the sheet P is heated from the opposite face Pb opposite the liquid applied face Pa and is warped so that the liquid applied face Pa is formed in a concave shape. By so doing, the deformation of the sheet P such as back curl is restrained effectively.

Figure 24:
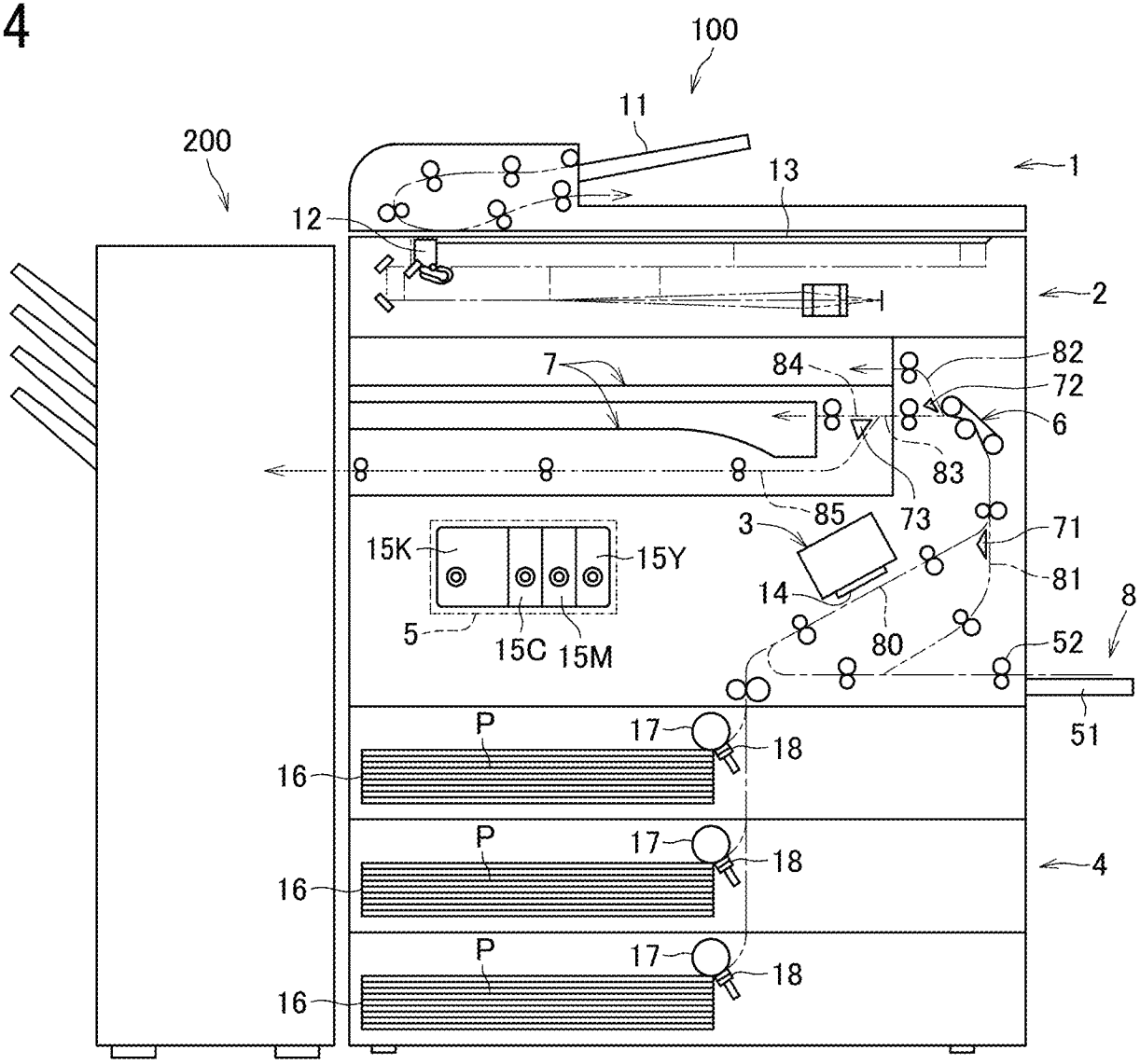
FIG. 24 is a diagram illustrating an example that the drying device according to the present disclosure is provided in another image forming apparatus.
Figure 25:
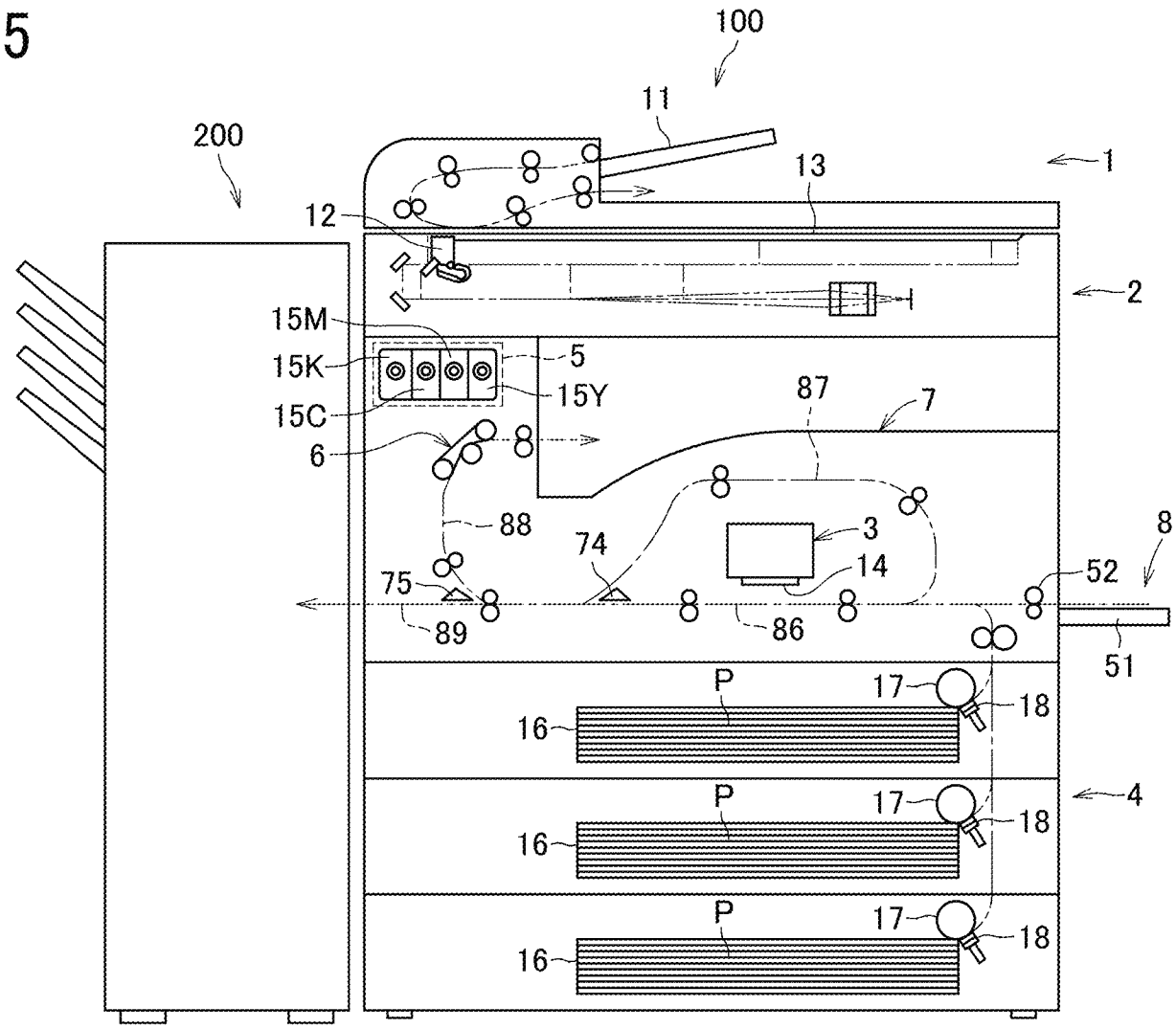
FIG. 25 is a diagram illustrating an example that the drying device according to the present disclosure is provided in yet another image forming apparatus.

Further, the drying device (heating device) according to the present disclosure is not limited to the image forming apparatus having the configuration as illustrated in FIG. 1 but may be applied, for example, to the image forming apparatus having the configuration as illustrated in FIG. 24 or FIG. 25.

Next, a description is given of the configuration of the image forming apparatus 100 with reference to FIGS. 24 and 25.

FIG. 24 is a diagram illustrating an example that the drying device according to the present disclosure is provided in another image forming apparatus 100.

FIG. 25 is a diagram illustrating an example that the drying device according to the present disclosure is provided in yet another image forming apparatus 100.

Note that the following description is given of the configuration of the image forming apparatus 100 of FIGS. 24 and 25 different from the configuration of the image forming apparatus 100 according to the above-described embodiment. That is, the description of the configuration of the image forming apparatus 100 of FIGS. 24 and 25 that is same as the configuration of the image forming apparatus 100 according to the above-described embodiment may be omitted.

Similar to the image forming apparatus 100 according to the above-described embodiments, the image forming apparatus 100 illustrated in FIG. 24 includes the original document conveying device 1, the image reading device 2, the image forming device 3, the sheet feeding device 4, the cartridge container 5, the drying device (heating device) 6, and the sheet ejection portion 7. Different from the image forming apparatus 100 according to the above-described embodiments, the image forming apparatus 100 illustrated in FIG. 24 further includes a bypass sheet feeding device 8. Different from the image forming device 3 in FIG. 1, the image forming device 3 in FIG. 24 is disposed facing a sheet conveyance passage 80 in which the sheet P is conveyed in a direction obliquely to the horizontal direction.

The bypass sheet feeding device 8 includes a bypass tray 51 and a bypass sheet feed roller 52. The bypass tray 51 functions as a sheet loader to load the sheet P. The bypass sheet feed roller 52 functions as a sheet feed body to feed the sheet P from the bypass tray 51. The bypass tray 51 is attached to open and close with respect to the housing of the image forming apparatus 100. In other words, the bypass tray 51 is rotatably attached to the housing of the image forming apparatus 100. When the bypass tray 51 is open (state in FIG. 24), the sheet P or the bundle of sheets including the sheet P is loaded on the bypass tray 51 to feed the sheet P to the housing of the image forming apparatus 100.

In the image forming apparatus 100 illustrated in FIG. 24, as a print job start instruction is issued, the sheet P is fed from the sheet feeding device 4 or from the bypass sheet feeding device 8 and is conveyed to the image forming device 3. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 71 guides the sheet P to a sheet reverse passage 81. Then, as the sheet P passes the sheet reverse passage 81, the sheet P is reversed from the front face to the back face, and then is conveyed to the image forming device 3 again to form an image on the back face of the sheet P.

The sheet P having the image on one side or both sides is conveyed to the drying device 6 in which the ink on the sheet P is dried. Note that, when drying the ink on the front face of the sheet P and then forming an image on the back face of the sheet P, the drying device 6 may dry the ink on the front face of the sheet P first, and then, the sheet P may be conveyed in a sheet conveyance passage that detours the drying device 6. Then, the direction of conveyance of the sheet P may be switched back (changed) to the upstream side from the drying device 6 in the sheet conveyance direction, and the sheet P may be guided to the image forming device 3 again via the sheet reverse passage 81. After the sheet P has passed the drying device 6, a second passage changer 72 guides the sheet P selectively to a sheet conveyance passage 82 that runs toward the upper sheet ejection portion 7 or to a sheet conveyance passage 83 that runs to the lower sheet ejection portion 7. In a case in which the sheet P is guided to the sheet conveyance passage 82 toward the upper sheet ejection portion 7, the sheet P is ejected to the upper sheet ejection portion 7. On the other hand, when the sheet P is guided to the sheet conveyance passage 83 toward the lower sheet ejection portion 7, a third passage changer 73 guides the sheet P selectively to a sheet conveyance passage 84 toward the lower sheet ejection portion 7 or to a sheet conveyance passage 85 toward the sheet alignment apparatus 200.

Then, when the sheet P is guided to the sheet conveyance passage 84 toward the lower sheet ejection portion 7, the sheet P is ejected to the lower sheet ejection portion 7. On the other hand, when the sheet P is guided to the sheet conveyance passage 85 toward the sheet alignment apparatus 200, the sheet is conveyed to the sheet alignment apparatus 200, so that the bundle of sheets P is aligned and stacked.

Similar to the image forming apparatus 100 illustrated in FIG. 24, the image forming apparatus 100 illustrated in FIG. 25 includes the original document conveying device 1, the image reading device 2, the image forming device 3, the sheet feeding device 4, the cartridge container 5, the drying device (heating device) 6, the sheet ejection portion 7, and the bypass sheet feeding device 8. Note that, in this case, similar to the image forming device 3 in FIG. 1, the image forming device 3 in FIG. 25 is disposed facing a sheet conveyance passage 86 in which the sheet P is conveyed in the horizontal direction.

In the image forming apparatus 100 illustrated in FIG. 25, as a print job start instruction is issued, the sheet P is fed from the sheet feeding device 4 or from the bypass sheet feeding device 8 and is conveyed to the image forming device 3. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 74 guides the sheet P to a sheet reverse passage 87. Then, as the sheet P passes the sheet reverse passage 87, the sheet P is reversed from the front face to the back face and is conveyed to the image forming device 3 again, so that an image is formed on the back face of the sheet P.

After an image is formed on one side or both sides of the sheet P, a second passage changer 75 guides the sheet P selectively to a sheet conveyance passage 88 that runs toward the drying device 6 or to a sheet conveyance passage 89 that runs to the sheet alignment apparatus 200. When the sheet P is guided to the sheet conveyance passage 88 toward the drying device 6, the drying device 6 dries the ink on the sheet P. Note that, when drying the ink on the front face of the sheet P and then forming an image on the back face of the sheet P, the drying device 6 may dry the ink on the front face of the sheet P first, and then, the sheet P may be conveyed in a sheet conveyance passage that detours the drying device 6. Then, the direction of conveyance of the sheet P may be switched back (changed) to the upstream side from the sheet conveyance passage 88 (upstream sides from the drying device 6) in the sheet conveyance direction, and the sheet P may be guided to the image forming device 3 again via the sheet reverse passage 87. Consequently, the sheet P that has passed the drying device 6 is ejected to the sheet ejection portion 7. On the other hand, when the sheet P is guided to the sheet conveyance passage 89 toward the sheet alignment apparatus 200, the sheet P is conveyed to the sheet alignment apparatus 200, so that the bundle of sheets P is aligned and stacked.

As the drying device 6 provided to the image forming apparatus 100 as illustrated in FIGS. 24 and 25, the drying device (heating device) according to the present disclosure is applied to achieve the same effect as the above-described embodiments. That is, the drying device 6 according to the present disclosure heats the sheet P from the opposite face Pb opposite the liquid applied face Pa and warps the sheet P in the curved portion 40*a*, thereby effectively restraining generation of the back curl. Further, since the ink on the sheet P is effectively dried before the sheet P reaches the pressure roller 43, generation of wrinkles on the sheet P is restrained.

Further, in the drying device (heating device) according to the present disclosure, the sheet is conveyed via the curved portion between the pressing member (pressure roller) and the belt (heating belt). Therefore, even when the sheet has stiffness (high rigidity), the sheet is easily warped to change the direction of conveyance of the sheet. In particular, this configuration of the drying device is effective to the configuration of the image forming apparatus for conveying the sheet from the vertical direction to the horizontal direction, such as the image forming apparatuses 100 illustrated in FIGS. 1, 24, and 25. Therefore, the drying device 6 according to the present embodiment is disposed near the sheet ejection port through which the sheet is ejected from the image forming apparatus, and the sheet is ejected reliably.

Further, in addition to the image forming apparatus, the drying device (heating device) according to the present disclosure may be applied to a liquid applying apparatus that applies liquid that does not form an image on a sheet.

Figure 26:
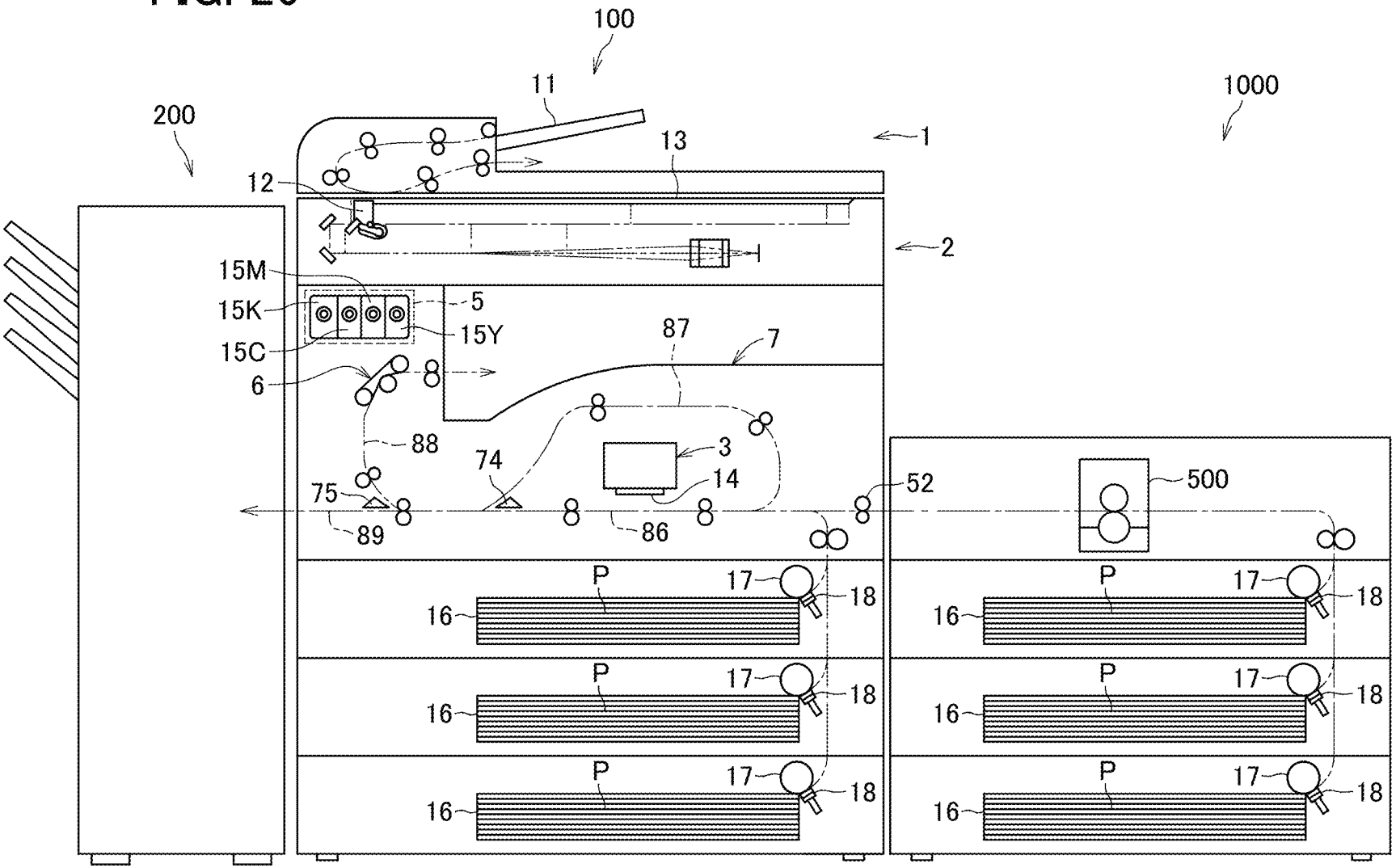
FIG. 26 is a diagram illustrating an example that the drying device according to the present disclosure is provided in a liquid applying apparatus.

For example, FIG. 26 is a diagram illustrating an example that the drying device 6 according to the present disclosure is provided in a liquid applying apparatus 1000.

That is, the drying device (heating device) according to the present disclosure may be applied to the liquid applying apparatus 1000. The liquid applying apparatus 1000 includes an inkjet image forming apparatus 100 that discharges ink to form an image on the sheet and a processing liquid applier 500 that discharges or applies a processing liquid on the surface of the sheet, as illustrated in FIG. 26, for the purpose of modifying and enhancing the surface of the sheet. Note that the processing liquid applier 500 illustrated in FIG. 26 applies a processing liquid onto the surface of the sheet P, then the liquid discharge head 14 discharges ink to apply the ink on the surface of the sheet P, and the drying device 6 dries the sheet P. However, the operation flow is not limited to the above-described flow. For example, the processing liquid applier 500 may apply a processing liquid onto the surface of the sheet P then the drying device 6 may dry the sheet P and the sheet may be conveyed to the sheet feed roller 52.

Figure 27:
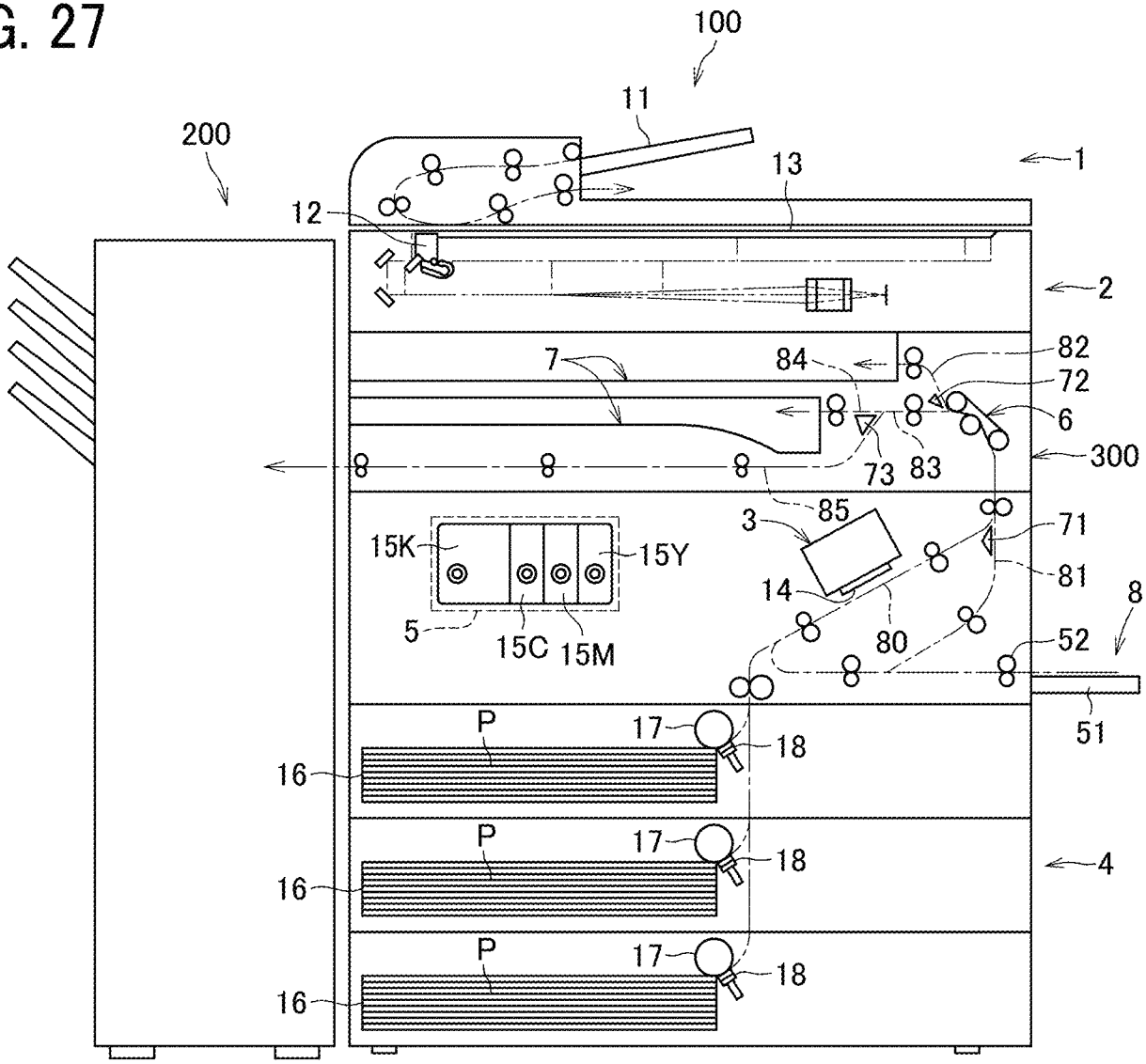
FIG. 27 is a diagram illustrating an example that the drying device according to the present disclosure is provided in a conveying device.

FIG. 27 is a diagram illustrating an example that the drying device according to the present disclosure is provided in a conveying device.

The drying device (heating device) according to the present disclosure may be applied to a conveying device 300 illustrated in FIG. 27. The conveying device 300 is detachably attached to the image forming apparatus 100. The conveying device 300 includes the sheet conveyance passages 82 to 85 through which the sheet passes, the drying device 6 to dry the sheet, and the sheet ejection portion 7 to which the sheet is discharged. The conveying device 300 is detachably attached between the image reading device 2 and the image forming device 3. Further, the conveying device 300 conveys the sheet to a post-processing device (for example, the sheet alignment apparatus 200) that performs a certain process to the sheet that has passed the drying device 6. By providing the drying device (heating device) according to the present disclosure to the conveying device 300 that is detachably attached to the image forming apparatus 100, even if deformation of the sheet such as a curl occurs in the image forming apparatus 100, the drying device 6 provided in the conveying device 300 restrains the deformation of the sheet effectively.

Figure 28:
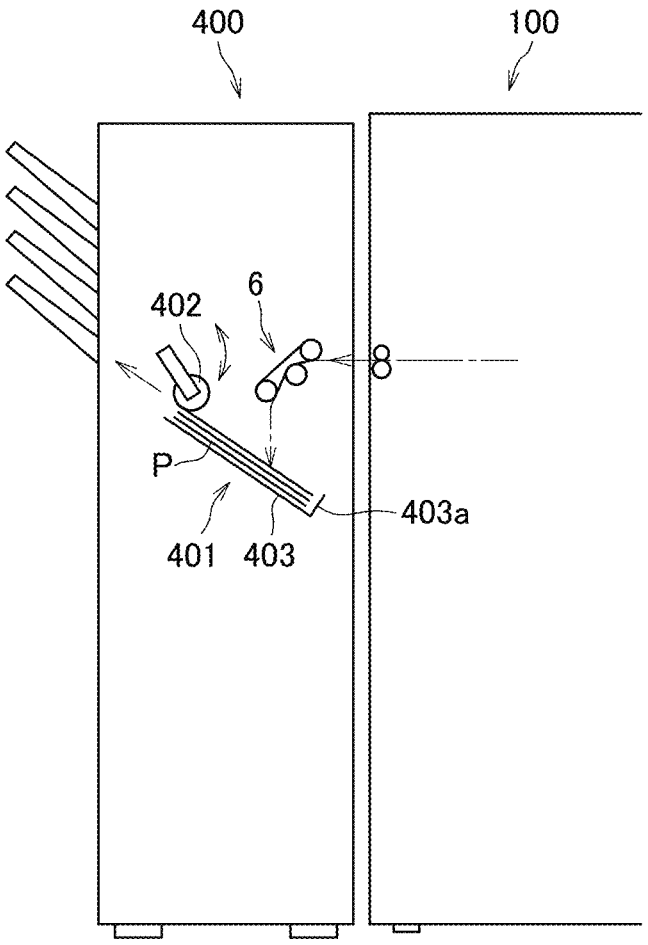
FIG. 28 is a diagram illustrating an example that the drying device according to the present disclosure is provided in a post-processing apparatus.

FIG. 28 is a diagram illustrating an example that the drying device according to the present disclosure is provided in a post-processing apparatus.

The drying device (heating device) according to the present disclosure may be applied to a post-processing apparatus 400 as illustrated in FIG. 28. The post-processing apparatus 400 includes the drying device 6 that heats the sheet and a post-processing device 401 that performs a stapling process and a punching process to the sheet.

As the sheet is conveyed from the image forming apparatus 100 to the post-processing apparatus 400 illustrated in FIG. 28, the sheet is conveyed by the drying device 6 and is loaded on a sheet stacking tray 403 of the post-processing device 401. At this time, in a case in which the sheet is stacked in the sheet stacking tray 403 with the face up (with the image forming surface facing up), the order of image formation may be set to be reversed, in other words, the image may be formed from the last page first. Further, the sheet P stacked on the sheet stacking tray 403 is conveyed by a sheet conveying roller 402 provided in the post-processing device 401 in the reverse direction with the trailing end to the leading end. By so doing, the trailing end of the sheet P contacts a trailing end regulator 403*a* of the sheet stacking tray 403, so that the position of the trailing end of the sheet P is aligned. Further, in order not to hinder ejection of the sheet to the sheet stacking tray 403, the sheet conveying roller 402 is disposed to be movable from a position at which the sheet conveying roller 402 contacts the sheet P to a retreat position at which the sheet conveying roller 402 does not contact the sheet P. In the state in which the position of the trailing end of the sheet P is aligned, the stapling process and the punching process are performed to the sheet P. Thereafter, the sheet conveying roller 402 rotates in the reverse direction, and therefore the sheet P on the sheet stacking tray 403 is ejected to the outside of the post-processing apparatus 400. As the drying device (heating device) according to the present disclosure is provided to the post-processing apparatus 400 described above, even if the image forming apparatus 100 generates deformation of the sheet such as a curl, the drying device 6 provided in the post-processing apparatus 400 restrains the deformation of the sheet effectively.

Further, the sheet to be heated by the drying device (heating device) according to the present disclosure may be a cut paper that is previously cut in the predetermined size in the sheet conveying direction or a roll sheet that is a longitudinal-length sheet wound in a roll shape. However, in a case of the roll sheet, the sheet is generally conveyed while being stretched by the sheet conveying rollers disposed at intervals in the sheet conveyance direction. Therefore, even when a force to generate deformation of the sheet, such as a curl, is applied in the middle of conveyance, the sheet is conveyed while restraining the deformation of the sheet to some extent by the tension applied to the sheet. By contrast, in a case of a cut sheet, the sheet is not conveyed while being stretched by the sheet conveying roller. Therefore, in a case of a cut sheet, it is likely that the conveyance failure and the insufficient drying process occur due to the deformation of the sheet such as a curl.

Accordingly, the drying device (heating device) according to the present embodiment is preferable to the image forming apparatus particularly using cut sheets. That is, the drying device (heating device) according to the present disclosure causes the pressing member (pressure roller) to press the sheet against the belt (heating belt), so as to contact the sheet to the belt (heating belt) and apply the decurling force to the sheet while heating the sheet from the face opposite the liquid applied face. Therefore, deformation of the sheet is restrained effectively.

Accordingly, the drying device (heating device) according to the present embodiment is preferable to the image forming apparatus using, in particular, cut sheets. However, the present disclosure does not exclude application of an image forming apparatus using a roll sheet. By providing the drying device (heating device) according to the present disclosure to the image forming apparatus using the roll sheet, deformation of the sheet such as back curl and cockling is restrained effectively.

Further, the sheet to be heated by the drying device (heating device) according to the present disclosure may be paper or any other material. As long as the sheet has flexibility and is conveyable while being warped, the sheet may be paper sheet, resin, metal, cloth, or leather.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

What is claimed is:

1. A heating device, comprising:

a belt which is a heating member configured to heat a sheet on an opposite face opposite a liquid applied face, the heating member having a curved portion along which the sheet is conveyed and warped so that the liquid applied face has a concave shape;

a plurality of belt supports around which the belt is wound;

a heater to heat the belt;

a roller to press an outer circumferential surface of the belt between the plurality of belt supports to form the curved portion of the belt; and a projecting rotator having a plurality of projections projecting radially outward, the projecting rotator facing an outer circumferential surface of the belt.

2. The heating device according to claim 1, wherein at least one of the plurality of belt supports is a heat rotator inside which the heater is disposed.

3. The heating device according to claim 2, wherein one of the plurality of belt supports is disposed downstream from the roller in a conveyance direction of the sheet, and wherein the one of the plurality of belt supports and the roller are spaced away from each other in the conveyance direction of the sheet and are in contact with the belt separately.

4. The heating device according to claim 1, wherein the heater is disposed upstream from the roller in a conveyance direction of the sheet.

5. The heating device according to claim 1, wherein the plurality of belt supports and the roller are spaced away from each other in a conveyance direction of the sheet and are in contact with the belt separately.

6. The heating device according to claim 1, further comprising another heater configured to heat the roller.

7. The heating device according to claim 1, wherein the roller is in contact with the belt in a contact area, and wherein a length of the contact area in a conveyance direction of the sheet is changeable.

8. The heating device according to claim 1, wherein the heating member is configured to convey the sheet from upstream from the curved portion of the heating member toward the curved portion of the heating member in a conveyance direction of the sheet.

9. The heating device according to claim 8, wherein: one of the plurality of belt supports is disposed downstream from the roller in the conveyance direction of the sheet, and the one of the plurality of belt supports and the roller are spaced away from each other in the conveyance direction of the sheet and are in contact with the belt separately.

10. A liquid applying apparatus comprising:

a liquid discharge head configured to apply a liquid to a sheet; and the heating device according to claim 1.

11. An image forming apparatus comprising:

a printer configured to form an image on a sheet with liquid; and the heating device according to claim 1.

12. A post-processing apparatus comprising:

the heating device according to claim 1; and a post-processor to perform a post-processing operation to a sheet that has passed the heating device.

13. A conveying device comprising:

the heating device according to claim 1; and a conveyance passage configured to convey a sheet that has passed the heating device, to a post-processor to perform a post-processing operation to the sheet.

14. A heating device, comprising:

a belt to heat a sheet on an opposite face opposite a liquid applied face, the belt including:

a curved portion along which the sheet is conveyed and warped so that the liquid applied face has a concave shape;

an upstream portion along which the sheet is conveyed to the curved portion;

a downstream portion along which the sheet is conveyed from the curved portion, the downstream portion begins immediately after the curved portion, and ends where the sheet is separated from the belt, wherein:

the belt is a single continuous belt which includes the upstream portion, the curved portion, and the downstream portion, the upstream portion is longer than the downstream portion, the heating device further comprising a rotator facing an outer circumferential surface of the upstream portion, the rotator to press the sheet against the outer circumferential surface of the upstream portion so that the belt at the upstream portion heats the opposite face of the sheet longer than the belt heats the opposite face of the sheet at the downstream portion.

15. The heating device according to claim 14, wherein:

the belt at the upstream portion is straight from where the sheet contacts the belt to the curved portion, and the belt at the downstream portion is straight from the curved portion to where the sheet separates from the belt.

16. The heating device according to claim 14, wherein:

the curved portion is formed by a roller adjacent the outer circumferential surface of the belt, and the rotator is different from the roller.

17. A heating device, comprising:

a belt to heat a sheet on an opposite face opposite a liquid applied face, the belt including:

a curved portion along which the sheet is conveyed and warped so that the liquid applied face has a concave shape; and an upstream portion along which the sheet is conveyed to the curved portion, the upstream portion begins at a portion of the belt which initially contacts the sheet, and ends where the curved portion of the belt begins, the heating device further comprising a sheet affector which causes the sheet to contact the upstream portion, wherein:

the sheet is contacted by the sheet affector and heated at the upstream portion by the belt without contacting another belt at the upstream portion.

18. The heating device according to claim 17, wherein:

the sheet affector includes a projecting rotator.

19. The heating device according to claim 17, wherein:

the sheet affector includes a fan.

20. The heating device according to claim 19, wherein:

the belt is an endless belt, and the fan is at an exterior of the endless belt.

21. The heating device according to claim 19, wherein:

the belt is an endless belt, and the fan is at an interior of the endless belt.

22. The heating device according to claim 17, wherein:

the upstream portion begins at a portion of the belt contacting a first roller which is a closest roller to where the sheet first contacts the belt, the upstream portion ends where the belt contacts a second roller at the curved portion, and the belt at the upstream portion is wrapped around only the first roller and the second roller.

* * * * *